US008961774B2

(12) United States Patent
Cole et al.

(10) Patent No.: US 8,961,774 B2
(45) Date of Patent: Feb. 24, 2015

(54) ELECTROCHEMICAL PRODUCTION OF BUTANOL FROM CARBON DIOXIDE AND WATER

(75) Inventors: Emily Barton Cole, Princeton, NJ (US); Kyle Teamey, Washington, DC (US); Andrew B. Bocarsly, Plainsboro, NJ (US); Narayanappa Sivasankar, Plainsborough, NJ (US)

(73) Assignee: Liquid Light, Inc., Monmouth Junction, NJ (US)

( * ) Notice: Subject to any disclaimer, the term of this patent is extended or adjusted under 35 U.S.C. 154(b) by 728 days.

(21) Appl. No.: 13/307,965

(22) Filed: Nov. 30, 2011

(65) Prior Publication Data

US 2012/0132538 A1 May 31, 2012

Related U.S. Application Data

(60) Provisional application No. 61/417,938, filed on Nov. 30, 2010, provisional application No. 61/418,034, filed on Nov. 30, 2010.

(51) Int. Cl.
*C25B 3/00* (2006.01)
*C25B 3/04* (2006.01)

(52) U.S. Cl.
CPC ..... *C25B 3/04* (2013.01)
USPC ..... 205/450; 205/440; 205/334

(58) Field of Classification Search
USPC ..... 205/440, 340, 334, 450; 204/242
See application file for complete search history.

(56) References Cited

U.S. PATENT DOCUMENTS

| | | | |
|---|---|---|---|
| 1,280,622 | A | 10/1918 | Andrews |
| 1,962,140 | A | 6/1934 | Dreyfus |
| 3,019,256 | A | 1/1962 | Dunn |
| 3,088,990 | A | 5/1963 | Rightmire et al. |
| 3,236,879 | A | 2/1966 | Chiusoli |
| 3,344,046 | A | 9/1967 | Neikam |

(Continued)

FOREIGN PATENT DOCUMENTS

| | | | |
|---|---|---|---|
| AU | 2012202601 | A1 | 5/2012 |
| CA | 2604569 | A1 | 10/2006 |

(Continued)

OTHER PUBLICATIONS

Kaneco et al., "Electrochemical Conversion of Carbon Dioxide to Formic Acid on Pb in KOH/Methanol Electrolyte at Ambient Temperature and Pressure", Energy (no month, 1998), vol. 23, No. 12, pp. 1107-1112.

(Continued)

*Primary Examiner* — Luan Van
*Assistant Examiner* — Radha Narayanan
(74) *Attorney, Agent, or Firm* — Suiter Swantz pc llo

(57) ABSTRACT

Methods and systems for electrochemical production of butanol are disclosed. A method may include, but is not limited to, steps (A) to (D). Step (A) may introduce water to a first compartment of an electrochemical cell. The first compartment may include an anode. Step (B) may introduce carbon dioxide to a second compartment of the electrochemical cell. The second compartment may include a solution of an electrolyte, a catalyst, and a cathode. Step (C) may apply an electrical potential between the anode and the cathode in the electrochemical cell sufficient for the cathode to reduce the carbon dioxide to a product mixture. Step (D) may separate butanol from the product mixture.

9 Claims, 4 Drawing Sheets

(56) References Cited

U.S. PATENT DOCUMENTS 3,347,758 A 10/1967 Koehl, Jr.
3,399,966 A 9/1968 Osamu Suzuki et al.
3,401,100 A 9/1968 Macklin
3,531,386 A 9/1970 Heredy
3,560,354 A 2/1971 Young
3,607,962 A 9/1971 Krekeler et al.
3,636,159 A 1/1972 Solomon
3,720,591 A 3/1973 Skarlos
3,745,180 A 7/1973 Rennie
3,764,492 A 10/1973 Baizer et al.
3,779,875 A 12/1973 Michelet
3,824,163 A 7/1974 Maget
3,894,059 A 7/1975 Selvaratnam
3,899,401 A 8/1975 Nohe et al.
3,959,094 A 5/1976 Steinberg
4,072,583 A 2/1978 Hallcher et al.
4,088,682 A 5/1978 Jordan
4,147,599 A 4/1979 O'Leary et al.
4,160,816 A 7/1979 Williams et al.
4,219,392 A 8/1980 Halmann
4,253,921 A 3/1981 Baldwin et al.
4,267,070 A 5/1981 Nefedov et al.
4,299,981 A 11/1981 Leonard
4,343,690 A 8/1982 De Nora
4,381,978 A 5/1983 Gratzel et al.
4,414,080 A 11/1983 Williams et al.
4,421,613 A 12/1983 Goodridge et al.
4,439,302 A 3/1984 Wrighton et al.
4,450,055 A 5/1984 Stafford
4,451,342 A 5/1984 Lichtin et al.
4,460,443 A 7/1984 Somorjai et al.
4,474,652 A 10/1984 Brown et al.
4,476,003 A 10/1984 Frank et al.
4,478,694 A 10/1984 Weinberg
4,478,699 A 10/1984 Halmann et al.
4,510,214 A 4/1985 Crouse et al.
4,545,886 A 10/1985 De Nora et al.
4,560,451 A 12/1985 Nielsen
4,563,254 A 1/1986 Morduchowitz et al.
4,595,465 A 6/1986 Ang et al.
4,608,132 A 8/1986 Sammells
4,608,133 A 8/1986 Morduchowitz et al.
4,609,440 A 9/1986 Frese, Jr. et al.
4,609,441 A 9/1986 Frese, Jr. et al.
4,609,451 A 9/1986 Sammells et al.
4,619,743 A 10/1986 Cook
4,620,906 A 11/1986 Ang
4,661,422 A 4/1987 Marianowski et al.
4,668,349 A 5/1987 Cuellar et al.
4,673,473 A 6/1987 Ang et al.
4,702,973 A 10/1987 Marianowski
4,732,655 A 3/1988 Morduchowitz et al.
4,756,807 A 7/1988 Meyer et al.
4,776,171 A 10/1988 Perry, Jr. et al.
4,793,904 A 12/1988 Mazanec et al.
4,810,596 A 3/1989 Ludwig
4,824,532 A 4/1989 Moingeon et al.
4,845,252 A 7/1989 Schmidt et al.
4,855,496 A 8/1989 Anderson et al.
4,897,167 A 1/1990 Cook et al.
4,902,828 A 2/1990 Wickenhaeuser et al.
4,921,586 A 5/1990 Molter
4,936,966 A 6/1990 Garnier et al.
4,945,397 A 7/1990 Schuetz
4,950,368 A 8/1990 Weinberg et al.
4,959,131 A 9/1990 Cook et al.
5,064,733 A 11/1991 Krist et al.
5,084,148 A 1/1992 Kazcur et al.
5,106,465 A 4/1992 Kaczur et al.
5,198,086 A 3/1993 Chlanda et al.
5,246,551 A 9/1993 Pletcher et al.
5,284,563 A 2/1994 Fujihira et al.
5,290,404 A 3/1994 Toomey
5,294,319 A 3/1994 Kaczur et al.
5,300,369 A 4/1994 Dietrich et al.
5,382,332 A 1/1995 Fujihira et al.
5,443,804 A 8/1995 Parker et al.
5,455,372 A 10/1995 Hirai et al.
5,474,658 A 12/1995 Scharbert et al.
5,514,492 A 5/1996 Marincic et al.
5,536,856 A 7/1996 Harrison et al.
5,587,083 A 12/1996 Twardowski
5,763,662 A 6/1998 Ikariya et al.
5,804,045 A 9/1998 Orillon et al.
5,858,240 A 1/1999 Twardowski et al.
5,928,806 A 7/1999 Olah et al.
5,961,813 A 10/1999 Gestermann et al.
6,001,500 A 12/1999 Bass et al.
6,024,935 A 2/2000 Mills et al.
6,137,005 A 10/2000 Honevik
6,171,551 B1 1/2001 Malchesky et al.
6,187,465 B1 2/2001 Galloway
6,251,256 B1 6/2001 Blay et al.
6,270,649 B1 8/2001 Zeikus et al.
6,312,655 B1 11/2001 Hesse et al.
6,348,613 B2 2/2002 Miyamoto et al.
6,409,893 B1 6/2002 Holzbock et al.
6,492,047 B1 12/2002 Peled et al.
6,657,119 B2 12/2003 Lindquist et al.
6,755,947 B2 6/2004 Schulze et al.
6,777,571 B2 8/2004 Chaturvedi et al.
6,806,296 B2 10/2004 Shiroto et al.
6,881,320 B1 4/2005 Krafton et al.
6,887,728 B2 5/2005 Miller et al.
6,906,222 B2 6/2005 Slany et al.
6,936,143 B1 8/2005 Graetzel et al.
6,942,767 B1 9/2005 Fazzina et al.
6,949,178 B2 9/2005 Tennakoon et al.
7,037,414 B2 5/2006 Fan
7,052,587 B2 5/2006 Gibson et al.
7,094,329 B2 8/2006 Saha et al.
7,138,201 B2 11/2006 Inoue et al.
7,314,544 B2 1/2008 Murphy et al.
7,318,885 B2 1/2008 Omasa
7,338,590 B1 3/2008 Shelnutt et al.
7,361,256 B2 4/2008 Henry et al.
7,378,561 B2 5/2008 Olah et al.
7,704,369 B2 4/2010 Olah et al.
7,883,610 B2 2/2011 Monzyk et al.
8,227,127 B2 7/2012 Little et al.
8,277,631 B2 10/2012 Eastman et al.
8,313,634 B2 11/2012 Bocarsly et al.
8,444,844 B1 5/2013 Teamey et al.
8,562,811 B2 10/2013 Sivasankar et al.
8,663,447 B2 3/2014 Bocarsly et al.
2001/0001798 A1 5/2001 Sharpless et al.
2001/0026884 A1 10/2001 Appleby et al.
2002/0122980 A1 9/2002 Fleischer et al.
2003/0029733 A1 2/2003 Otsuka et al.
2004/0089540 A1 5/2004 Van Heuveln et al.
2004/0115489 A1 6/2004 Goel
2005/0011755 A1 1/2005 Jovic et al.
2005/0011765 A1 1/2005 Omasa
2005/0051439 A1 3/2005 Jang
2005/0139486 A1 6/2005 Carson et al.
2005/0245784 A1 11/2005 Carson et al.
2006/0102468 A1 5/2006 Monzyk et al.
2006/0235091 A1 10/2006 Olah et al.
2006/0243587 A1 11/2006 Tulloch et al.
2006/0269813 A1 11/2006 Seabaugh et al.
2007/0004023 A1 1/2007 Trachtenberg et al.
2007/0012577 A1 1/2007 Bulan et al.
2007/0045125 A1 3/2007 Hartvigsen et al.
2007/0054170 A1 3/2007 Isenberg
2007/0122705 A1 5/2007 Paulsen et al.
2007/0184309 A1 8/2007 Gust, Jr. et al.
2007/0224479 A1 9/2007 Tadokoro et al.
2007/0231619 A1 10/2007 Strobel et al.
2007/0240978 A1 10/2007 Beckmann et al.
2007/0254969 A1 11/2007 Olah et al.
2007/0282021 A1 12/2007 Campbell
2008/0011604 A1 1/2008 Stevens et al.
2008/0039538 A1 2/2008 Olah et al.
2008/0060947 A1 3/2008 Kitsuka et al.

(56) References Cited

U.S. PATENT DOCUMENTS

| | | | |
|---|---|---|---|
| 2008/0072496 | A1 | 3/2008 | Yogev et al. |
| 2008/0090132 | A1 | 4/2008 | Ivanov et al. |
| 2008/0116080 | A1 | 5/2008 | Lal et al. |
| 2008/0145721 | A1 | 6/2008 | Shapiro et al. |
| 2008/0223727 | A1 | 9/2008 | Oloman et al. |
| 2008/0248350 | A1 | 10/2008 | Little et al. |
| 2008/0283411 | A1 | 11/2008 | Eastman et al. |
| 2008/0286643 | A1 | 11/2008 | Iwasaki |
| 2008/0287555 | A1 | 11/2008 | Hussain et al. |
| 2008/0296146 | A1 | 12/2008 | Toulhoat et al. |
| 2009/0014336 | A1 | 1/2009 | Olah et al. |
| 2009/0030240 | A1 | 1/2009 | Olah et al. |
| 2009/0038955 | A1 | 2/2009 | Rau |
| 2009/0057161 | A1 | 3/2009 | Aulich et al. |
| 2009/0061267 | A1 | 3/2009 | Monzyk et al. |
| 2009/0062110 | A1 | 3/2009 | Koshino et al. |
| 2009/0069452 | A1 | 3/2009 | Robota |
| 2009/0134007 | A1 | 5/2009 | Solis Herrera |
| 2009/0156867 | A1 | 6/2009 | Van Kruchten |
| 2009/0277799 | A1 | 11/2009 | Grimes |
| 2009/0308759 | A1 | 12/2009 | Waycuilis |
| 2010/0061922 | A1 | 3/2010 | Rauser et al. |
| 2010/0069600 | A1 | 3/2010 | Morelle et al. |
| 2010/0084280 | A1 | 4/2010 | Gilliam et al. |
| 2010/0130768 | A1 | 5/2010 | Sato et al. |
| 2010/0147699 | A1 | 6/2010 | Wachsman et al. |
| 2010/0150802 | A1 | 6/2010 | Gilliam et al. |
| 2010/0180889 | A1 | 7/2010 | Monzyk et al. |
| 2010/0187123 | A1 | 7/2010 | Bocarsly et al. |
| 2010/0187125 | A1 | 7/2010 | Sandoval et al. |
| 2010/0191010 | A1 | 7/2010 | Bosman et al. |
| 2010/0193370 | A1 | 8/2010 | Olah et al. |
| 2010/0196800 | A1 | 8/2010 | Markoski et al. |
| 2010/0213046 | A1 | 8/2010 | Grimes et al. |
| 2010/0248042 | A1 | 9/2010 | Nakagawa et al. |
| 2010/0282614 | A1 | 11/2010 | Detournay et al. |
| 2010/0305629 | A1 | 12/2010 | Lund et al. |
| 2010/0307912 | A1 | 12/2010 | Zommer |
| 2011/0014100 | A1 | 1/2011 | Bara et al. |
| 2011/0024288 | A1 | 2/2011 | Bhavaraju et al. |
| 2011/0083968 | A1 | 4/2011 | Gilliam et al. |
| 2011/0114501 | A1 | 5/2011 | Teamey et al. |
| 2011/0114502 | A1 | 5/2011 | Cole et al. |
| 2011/0114503 | A1 | 5/2011 | Sivasankar et al. |
| 2011/0114504 | A1 | 5/2011 | Sivasankar et al. |
| 2011/0143929 | A1 | 6/2011 | Sato et al. |
| 2011/0177398 | A1 | 7/2011 | Affinito et al. |
| 2011/0186441 | A1 | 8/2011 | LaFrancois et al. |
| 2011/0217226 | A1 | 9/2011 | Mosa et al. |
| 2011/0226632 | A1 | 9/2011 | Cole et al. |
| 2011/0237830 | A1 | 9/2011 | Masel |
| 2011/0303551 | A1 | 12/2011 | Gilliam et al. |
| 2011/0318617 | A1 | 12/2011 | Kirchev et al. |
| 2012/0018311 | A1 | 1/2012 | Yotsuhashi et al. |
| 2012/0043301 | A1 | 2/2012 | Arvin et al. |
| 2012/0132537 | A1 | 5/2012 | Sivasankar et al. |
| 2012/0132538 | A1 | 5/2012 | Cole et al. |
| 2012/0199493 | A1 | 8/2012 | Krafft et al. |
| 2012/0215034 | A1 | 8/2012 | McFarland |
| 2012/0228147 | A1 | 9/2012 | Sivasankar et al. |
| 2012/0277465 | A1 | 11/2012 | Cole et al. |
| 2012/0292196 | A1 | 11/2012 | Albrecht et al. |
| 2012/0295172 | A1 | 11/2012 | Peled et al. |
| 2012/0298522 | A1 | 11/2012 | Shipchandler et al. |
| 2012/0329657 | A1 | 12/2012 | Eastman et al. |
| 2013/0062216 | A1 | 3/2013 | Yotsuhashi et al. |
| 2013/0098772 | A1 | 4/2013 | Bocarsly et al. |
| 2013/0105304 | A1 | 5/2013 | Kaczur et al. |
| 2013/0105330 | A1 | 5/2013 | Teamey et al. |
| 2013/0118907 | A1 | 5/2013 | Deguchi et al. |
| 2013/0118911 | A1 | 5/2013 | Sivasankar et al. |
| 2013/0134048 | A1 | 5/2013 | Teamey et al. |
| 2013/0134049 | A1 | 5/2013 | Teamey et al. |
| 2013/0140187 | A1 | 6/2013 | Teamey et al. |
| 2013/0180863 | A1 | 7/2013 | Kaczur et al. |
| 2013/0180865 | A1 | 7/2013 | Cole et al. |
| 2013/0186771 | A1 | 7/2013 | Zhai et al. |
| 2013/0199937 | A1 | 8/2013 | Cole et al. |

FOREIGN PATENT DOCUMENTS

| | | | |
|---|---|---|---|
| CN | 102190573 | A | 9/2011 |
| DE | 1047765 | A | 12/1958 |
| DE | 2301032 | A | 7/1974 |
| EP | 0028430 | A1 | 5/1981 |
| EP | 0111870 | B1 | 12/1983 |
| EP | 0081982 | B1 | 5/1985 |
| EP | 0277048 | B1 | 3/1988 |
| EP | 0390157 | B1 | 5/2000 |
| EP | 2329875 | A1 | 6/2011 |
| FR | 853643 | | 3/1940 |
| FR | 2780055 | A1 | 12/1999 |
| GB | 1223452 | A | 2/1971 |
| GB | 1285209 | A | 8/1972 |
| JP | 62120489 | A | 6/1987 |
| JP | 64-015388 | | 1/1989 |
| JP | 07258877 | A | 10/1995 |
| JP | 2004344720 | A | 12/2004 |
| JP | 2006188370 | A | 7/2006 |
| JP | 2007185096 | A | 7/2007 |
| KR | 20040009875 | A | 1/2004 |
| WO | 91/01947 | A1 | 2/1991 |
| WO | WO 9724320 | A1 | 7/1997 |
| WO | 9850974 | A1 | 11/1998 |
| WO | WO9850974 | A1 | 11/1998 |
| WO | WO 0015586 | A1 | 3/2000 |
| WO | WO0025380 | A2 | 5/2000 |
| WO | WO020599873 | A3 | 8/2002 |
| WO | WO 03004727 | A2 | 1/2003 |
| WO | WO 2004067673 | A1 | 8/2004 |
| WO | 2006074335 | A2 | 7/2006 |
| WO | 2007041872 | A1 | 4/2007 |
| WO | WO 2007041872 | A1 | 4/2007 |
| WO | WO2007041872 | A1 | 4/2007 |
| WO | WO2007058608 | A1 | 5/2007 |
| WO | 2007/091616 | A1 | 8/2007 |
| WO | WO2007119260 | A2 | 10/2007 |
| WO | WO2008016728 | A2 | 2/2008 |
| WO | WO2008017838 | A1 | 2/2008 |
| WO | WO2008124538 | A1 | 10/2008 |
| WO | WO2009002566 | A1 | 12/2008 |
| WO | 2009108327 | A1 | 9/2009 |
| WO | WO2009145624 | A1 | 12/2009 |
| WO | WO2010010252 | A2 | 1/2010 |
| WO | WO2010042197 | A1 | 4/2010 |
| WO | WO2010088524 | A2 | 8/2010 |
| WO | WO2010138792 | A1 | 12/2010 |
| WO | WO2011010109 | A1 | 1/2011 |
| WO | 2011069008 | | 6/2011 |
| WO | WO2011068743 | A2 | 6/2011 |
| WO | 2011116236 | A2 | 9/2011 |
| WO | WO2011120021 | A1 | 9/2011 |
| WO | WO2011123907 | A1 | 10/2011 |
| WO | WO2011133264 | A1 | 10/2011 |
| WO | 2011160577 | A1 | 12/2011 |
| WO | 2012015921 | A1 | 2/2012 |
| WO | WO 2012046362 | A1 | 4/2012 |
| WO | 2012166997 | A2 | 12/2012 |

OTHER PUBLICATIONS

Wu et al., "Electrochemical Reduction of Carbon Dioxide I. Effects of the Electrolyte on the Selectivity and Activity with Sn Electrode", Journal of the Electrochemical Society (no month, 2012), vol. 159, No. 7, pp. F353-F359.

Chaplin et al., "Effects of Process Conditions and Electrode Material on Reaction Pathways for Carbon Dioxide Electroreduction with Particular Reference to Formate Formation", Journal of Applied Electrochemistry (no month, 2003), vol. 33, pp. 1107-1123.

Jaime-Ferrer et al., "Three-Compartment Bipolar Membrane Electrodialysis for Splitting of Sodium Formate into Formic Acid and Sodium Hydroxide: Role of Diffusion of Molecular Acid", Journal of Membrane Science (no month, 2008), vol. 325, pp. 528-536.

(56) References Cited

OTHER PUBLICATIONS

Shibata et al., "Simultaneous Reduction of Carbon Dioxide and Nitrate Ions at Gas-Diffusion Electrodes with Various Metallophthalocyanine Catalysts", Electrochima Acta (no month, 2003), vol. 48, pp. 3953-3958.
Scibioh et al., "Electrochemical Reduction of Carbon Dioxide: A Status Report", Proc Indian Natn Sci Acad (May 2004), vol. 70, A, No. 3, pp. 407-462.
Shibata et al., "Electrochemical Synthesis of Urea at Gas-Diffusion Electrodes", J. Electrochem. Soc. (Jul. 1998), vol. 145, No. 7, pp. 2348-2353.
Non-Final Office Action for U.S. Appl. No. 12/875,227, dated Dec. 11, 2012.
Green et al., "Vapor-Liquid Equilibria of Formaldehyde-Methanol-Water", Industrial and Engineering Chemistry (Jan. 1955), vol. 47, No. 1, pp. 103-109.
Shibata et al., "Electrochemical Synthesis of Urea at Gas-Diffusion Electrodes Part VI. Simultaneous Reduction of Carbon Dioxide and Nitrite Ions with Various Metallophthalocyanine Catalysts". J. of Electroanalytical Chemistry (no month, 2001), vol. 507, pp. 177-184.
Jaaskelainen and Haukka, The Use of Carbon Dioxide in Ruthenium Carbonyl Catalyzed 1-hexene Hydroformylation Promoted by Alkali Metal and Alkaline Earth Salts, Applied Catalysis A: General, 247, 95-100 (2003).
Heldebrant et al., "Reversible Zwitterionic Liquids, The Reaction of Alkanol Guanidines, Alkanol Amidines, and Diamines wih CO2", Green Chem. (mo month, 2010), vol. 12, pp. 713-721.
Perez et al., "Activation of Carbon Dioxide by Bicyclic Amidines", J. Org. Chem. (no. month, 2004), vol. 69, pp. 8005-8011.
Stephen K. Ritter, What Can We Do With Carbon Dioxide? Scientists are trying to find ways to convert the plentiful greenhouse gas into fuels and other value-added products, Chemical & Engineering News, Apr. 30, 2007, vol. 85, No. 18, pp. 11-17, http://pubs.acs.org/cen/coverstory/85/8518cover.html.
Toshio Tanaka, Molecular Orbital Studies on the Two-Electron Reduction of Carbon Dioxide to Give Formate Anion, Memoirs of Fukui University of Technology, vol. 23, Part 1, 1993, pp. 223-230.
Columbia, Crabtree, and Thiel; The Temperature and Coverage Dependences of Adsorbed Formic Acid and Its Conversion to Formate on Pt(111), J. Am. Chem. Soc., vol. 114, No. 4, 1992, pp. 1231-1237.
Brian R. Eggins and Joanne McNeill, Voltammetry of Carbon Dioxide, Part I. A General Survey of Voltammetry at Different Electrode Materials in Different Solvents, J. Electroanal. Chem., 148 (1983) 17-24, Elsevier Sequoia S.A., Lausanne—Printed in the Netherlands.
Varghese, Paulose, Latempa, and Grimes; High-Rate Solar Photocatalytic Conversion of CO2 and Water Vapor to Hydrocarbon Fuels; Nano Letters, 2009, vol. 9, No. 2, pp. 731-737.
Han, Chu, Kim, Song, and Kim; Photoelectron spectroscopy and ab initio study of mixed cluster anions of [(CO21-3(Pyridine)1-6: Formation of a covalently bonded anion core of (C5H5N—CO2), Journal of Chemical Physics, vol. 113, No. 2, Jul. 8, 2000, pp. 596-601.
Heinze, Hempel, and Beckmann; Multielectron Storage and Photo-Induced Electron Transfer in Oligonuclear Complexes Containing Ruthenium(II) Terpyridine and Ferrocene Building Blocks, Eur. J. Inorg. Chem. 2006, 2040-2050.
Lin and Frei, Bimetallic redox sites for photochemical CO2 splitting in mesoporous silicate sieve, C. R. Chimie 9 (2006) 207-213.
Heyduk, MacIntosh, and Nocera; Four-Electron Photochemistry of Dirhodium Fluorophosphine Compounds, J. Am. Chem. Soc. 1999, 121, 5023-5032.
Witham, Huang, Tsung, Kuhn, Somorjai, and Toste; Converting homogeneous to heterogeneous in electrophilic catalysis using monodisperse metal nanoparticles, Nature Chemistry, DOI: 10.1038/NCHEM.468, pp. 1-6, 2009.
Hwang and Shaka, Water Suppression That Works. Excitation Sculpting Using Arbitrary Waveforms and Pulsed Field Gradients, Journal of Magnetic Resonance, Series A 112, 275-279 (1995).
Weissermel and Arpe, Industrial Organic Chemistry, 3rd Edition 1997, Published jointly by VCH Verlagsgesellschaft mbH, Weinheim (Federal Republic of Germany) VCH Pubiishers, Inc., New York, NY (USA), pp. 1-481.
T. Iwasita, . C. Nart, B. Lopez and W. Vielstich; On the Study of Adsorbed Species at Platinum From Methanol, Formic Acid and Reduced Carbon Dioxide Via In Situ FT-ir Spectroscopy, Electrochimica Atca, vol. 37. No. 12. pp. 2361-2367, 1992, Printed in Great Britain.
Lackner, Grimes, and Ziock; Capturing Carbon Dioxide From Air; pp. 1-15.
Kang, Kim, Lee, Hong, and Moon; Nickel-based tri-reforming catalyst for the production of synthesis gas, Applied Catalysis, A: General 332 (2007) 153-158.
Kostecki and Augustynski, Electrochemical Reduction of CO2 at an Activated Silver Electrode, Ber. Bunsenges. Phys. Chem. 98, 1510-1515 (1994) No. I2 C VCH Verlagsgesellschaft mbH, 0-69451 Weinheim, 1994.
Kunimatsu and Kita; Infrared Spectroscopic Study of Methanol and Formic Acid Adsorrates on a Platinum Electrode, Part II. Role of the Linear CO(a) Derived From Methanol and Formic Acid in the Electrocatalytic Oxidation of CH,OH and HCOOH, J Electroanal Chem., 218 (1987) 155-172, Elsevier Sequoia S A , Lausanne—Printed in the Netherlands.
Li and Prentice, Electrochemical Synthesis of Methanol from CO2 in High-Pressure Electrolyte, J. Electrochem. Soc., vol. 144, No. 12, Dec. 1997 © The Electrochemical Society, Inc., pp. 4284-4288.
Lichter and Roberts, 15N Nuclear Magnetic Resonance Spectroscopy. XIII. Pyridine-15N1, Journal of the American Chemical Society 1 93:20 1Oct. 6, 1971, pp. 5218-5224.
R.J.L. Martin, The Mechanism of the Cannizzaro Reaction of Formaldehyde, May 28, 1954, pp. 335-347.
Fujitani, Nakamura, Uchijima, and Nakamura; The kinetics and mechanism of methanol synthesis by hydrogenation of C02 over a Zn-deposited Cu(111surface, Surface Science 383 (1997) 285-298.
Richard S. Nicholson and Irving Shain, Theory of Stationary Electrode Polarography, Single Scan and Cyclic Methods Applied to Reversible, Irreversible, and Kinetic Systems, Analytical Chemistry, vol. 36, No. 4, Apr. 1964, pp. 706-723.
Noda, Ikeda, Yamamoto, Einaga, and Ito; Kinetics of Electrochemical Reduction of Carbon Dioxide on a Gold Electrode in Phosphate Buffer Solutions; Bull. Chem. Soc. Jpn., 68, 1889-1895 (1995).
Joseph W. Ochterski, Thermochemistry in Gaussian, (c)2000, Gaussian, Inc., Jun. 2, 2000, 19 Pages.
Kotaro Ogura and Mitsugu Takagi, Electrocatalytic Reduction of Carbon Dioxide to Methanol, Part IV. Assessment of the Current-Potential Curves Leading to Reduction, J. Electroanal. Chem., 206 (1986) 209-216, Elsevier Sequoia S.A., Lausanne—Printed in the Netherlands.
Ohkawa, Noguchi, Nakayama, Hashimoto, and Fujishima; Electrochemical reduction of carbon dioxide on hydrogen-storing materials, Part 3. The effect of the absorption of hydrogen on the palladium electrodes modified with copper; Journal of Electroanalytical Chemistry, 367 (1994) 165-173.
Ohmstead and Nicholson, Cyclic Voltammetry Theory for the Disproportionation Reaction and Spherical Diffusion, Analytical Chemistry, vol. 41, No. 6, May 1969, pp. 862-864.
Shunichi Fukuzumi, Bioinspired Energy Conversion Systems for Hydrogen Production and Storage, Eur. J. Inorg. Chem. 2008, 1339-1345.
Angamuthu, Byers, Lutz, Spek, and Bouwman; Electrocatalytic CO2 Conversion to Oxalate by a Copper Complex, Science, vol. 327, Jan. 15, 2010, pp. 313-315.
J. Fischer, Th. Lehmann, and E. Heitz; The production of oxalic acid from C02 and H2O, Journal of Applied Electrochemistry 11 (1981) 743-750.
Rosenthal, Bachman, Dempsey, Esswein, Gray, Hodgkiss, Manke, Luckett, Pistorio, Veige, and Nocera; Oxygen and hydrogen photocatalysis by two-electron mixed-valence coordination compounds, Coordination Chemistry Reviews 249 (2005) 1316-1326.

(56) References Cited

OTHER PUBLICATIONS

Rudolph, Dautz, and Jager; Macrocyclic [N42-] Coordinated Nickel Complexes as Catalysts for the Formation of Oxalate by Electrochemical Reduction of Carbon Dioxide, J. Am. Chem. Soc. 2000, 122, 10821-10830.
D.A. Shirley, High-Resolution X-Ray Photoemission Spectrum of the Valence Bands of Gold, Physical Review B, vol. 5, No. 12, Jun. 15, 1972, pp. 4709-4714.
S.G. Sun and J. Clavilier, The Mechanism of Electrocatalytic Oxidation of Formic Acid on Pt (100) and Pt (111) in Sulphuric Acid Solution: An Emirs Study, J. Electroanal. Chem., 240 (1988) 147-159, Elsevier Sequoia S.A., Lausanne—Printed in the Netherlands.
Sun, Lin, Li, and Mu; Kinetics of dissociative adsorption of formic acid on Pt(100), Pt(610), Pt(210), and Pt(110) single-crystal electrodes in perchloric acid solutions, Journal of Electroanalytical Chemistry, 370 (1994) 273-280.
Marek Szklarczyk, Jerzy Sobkowski and Jolanta Pacocha, Adsorption and Reduction of Formic Acid on p-Type Silicon Electrodes, J. Electroanal. Chem., 215 (1986) 307-316, Elsevier Sequoia S.A., Lausanne—Printed in the Netherlands.
Zhao, Fan, and Wang, Photo-catalytic CO2 reduction using sol-gel derived titania-supported zinc-phthalocyanine, Journal of Cleaner Production 15 (2007) 1894-1897.
Tanaka and Ooyama, Multi-electron reduction of CO2 via Ru-CO2, -C(O)OH, -CO, -CHO, and -CH2OH species, Coordination Chemistry Reviews 226 (2002) 211-218.
Toyohara, Nagao, Mizukawa, and Tanaka, Ruthenium Formyl Complexes as the Branch Point in Two- and Multi-Electron Reductions of CO2, Inorg. Chem. 1995, 34, 5399-5400.
Watanabe, Shibata, and Kato; Design of Ally Electrocatalysts for CO2 Reduction, III. The Selective and Reversible Reduction of CO2 on Cu Alloy Electrodes; J. Electrochem. Soc., vol. 138, No. 11, Nov. 1991, pp. 3382-3389.
Dr. Chao Lin, Electrode Surface Modification and its Application to Electrocatalysis, V. Catalytic Reduction of Carbon Dioxide to Methanol, Thesis, 1992, Princeton University, pp. 157-179.
Dr. Gayatri Seshadri, Part I. Electrocatalysis at modified semiconductor and metal electrodes; Part II. Electrochemistry of nickel and cadmium hexacyanoferrates, Chapter 2—The Electrocatalytic Reduction of CO2 to Methanol at Low Overpotentials, 1994, Princeton University, pp. 52-85.
Seshadri et al, "A new homogeneous catalyst for the reduction of carbon dioxide to methanol at low overpotential," Journal of Electroanalytical Chemistry, 372 (1994) 145-150.
Scibioh et al, "Electrochemical Reduction of Carbon Dioxide: A Status Report," Proc. Indian Natn Science Acad., 70, A, No. 3, May 2004, pp. 407-762.
Hori et al, "Enhanced Formation of Ethylene and Alcohols at Ambient Temperature and Pressure in Electrochemical Reduction of Carbon Dioxide at a Copper Electrode," J. Chem. Soc. Chem. Commun. (1988), pp. 17-19.
Hossain et al, "Palladium and Cobalt Complexes of Substituted Quinoline, Bipyridine and Phenanthroline as Catalysts for Electrochemical Reduction of Carbon Dioxide," Electrochimica Acta, vol. 42, No. 16 (1997), pp. 2577-2585.
Fischer, "Liquid Fuels from Water Gas", Industrial and Engineering Chemistry, vol. 17, No. 6, Jun. 1925, pp. 574-576.
Williamson et al, "Rate of Absorption and Equilibrium of Carbon Dioxide in Alkaline Solutions", Industrial and Engineering Chemistry, vol. 16, No. 11, Nov. 1924, pp. 1157-1161.
Hori, "Electrochemical CO2 Reduction on Metal Electrodes", Modern Aspects of Electrochemistry, No. 42, 2008, pp. 89-189.
Chen et al., "Tin oxide dependence of the CO2 reduction efficiency on tin electrodes and enhanced activity for tin/tin oxide thin-film catalysts." Journal of the American Chemical Society 134, No. 4 (2012): 1986-1989, Jan. 9, 2012, retrieved on-line.
Zhou et al. "Anodic passivation processes of indium in alkaline solution [J]" Journal of Chinese Society for Corrosion and Protection 1 (2005): 005, Feb. 2005.
Fukaya et al., "Electrochemical Reduction of Carbon Dioxide to Formate Catalyzed by Rh(bpy)3CI3", Kagaku Gijutsu Kenkyusho Hokoku (no month, 1986), vol. 81, No. 5, pp. 255-258.
James Grimshaw, Electrochemical Reactions and Mechanisms in Organic Chemistry, 2000, ISBN 978-0-444-72007-8. [retrieved on Jan. 3, 2014]. Retrieved from the internet. <URL: http://f3.tiera.ru/ShiZ/Great%20Science%20TextBooks/Great%Science%-20Textbooks%20DVD%20Library%20202007%20-%20Supplement%20Five/Chemistry/Organic%20Chemistry/Electrochemical%20Reactions%20and%20Mechanisms%20in%-20Organic%20Chemistry%20-%20J.%20Grimshaw%20%28Elsevier,%202000%29%WW.pdf>.
Fischer, J. et al. "The production of oxalic acid from CO2 and H2O." Journal of Applied Electrochemistry, 1981, vol. 11, pp. 743-750.
Goodridge, F. et al., The electrolytic reduction of carbon dioxide and monoxide for the production of carboxylic acids.: Journal of applied electrochemistry, 1984, vol. 14, pp. 791-796.
Nefedov and Manov-Yuvenskii, The Effect of Pyridine Bases and Transition-Metal Oxides on the Activity of PdCl2 in the Carbonylation of Aromatic Mononitro Compounds by Carbon Monoxide, 28 Bulletin of the Acad. of Sciences of the USSR 3, 540-543 (1979).
Vojinovic "Bromine oxidation and bromine reduction in propylene carbonate" Journal of Electroanalytical Chemistry, 547 (2003) p. 109-113.
Babic et al (Electrochimica Acta, 51, 2006, 3820-3826).
Yoshida et al. (Journal of Electroanalytical Chemistry, 385, 1995, 209-225).
Seshadri et al., "A new homogeneous electrocatalyst for the reduction of carbon dioxide to methanol at low overpotential", Journal of Electroanalytical Chemistry and Interfacial Electro Chemistry, Elsevier, Amsterdam, NL, vol. 372, No. 1-2, Jul. 8, 1994, pp. 145-150.
Hossain et al., "Palladium and cobalt complexes of substituted quinoline, bipyridine and phenanthroline as catalysts for electrochemical reduction of carbon dioxide", Electrochimica Acta, Elsevier Science Publishers, vol. 42, No. 16, Jan. 1, 1997, pp. 2577-2585.
Fisher et al., "Electrocatalytic reduction of carbon dioxide by using macrocycles of nickel and cobalt", Journal of the American Chemical Society, vol. 102, No. 24, Sep. 1, 1980, pp. 7361-7363.
Ishida et al., Selective Formation of HC00—in the Electrochemical CO2 Reduction Catalyzed by URU(BPY)2(CO)2 3/4 2+ (BPY = 2,2'-Bipyridine), Journal of the Chemical Society, Chemical Communications, Chemical Society, Letchworth, GB, Jan. 1, 1987, pp. 131-132.
Zhao et al., "Electrochemical reduction of supercritical carbon dioxide in ionic liquid 1-n-butyl-3-methylimidazolium hexafluorophosphate", Journal of Supercritical Fluids, PRA Press, US, vol. 32, No. 1-3, Dec. 1, 2004, pp. 287-291.
Hori et al, chapter on "Electrochemical CO2 Reduction on Metal Electrodes," in the book "Modern Aspects of Electrochemistry," vol. 42, pp. 106 and 107.
Czerwinski et al, "Adsorption Study of CO2 on Reticulated vitreous carbon (RVC) covered with platinum," Analytical Letters, vol. 18, Issue 14 (1985), pp. 1717-1722.
Hammouche et al, Chemical Catalysis of Electrochemical Reactions. Homogeneous Catalysis of the Electrochemical Reduction of Carbon Dioxide by Iron ("0") Porphyrins. Role of the Addition of Magnesium Cations. J. Am. Chem. Soc. 1991, 113, 8455-8466.
Hossain et al., Palladium and Cobalt Complexes of Substituted Quinoline, Bipyridine and Phenanthroline as Catalysts for Electrochemical Reduction of Carbon Dioxide, Electrochimica Acta (no month, 1997), vol. 42, No. 16, pp. 2577-2785.
R.P.S. Chaplin and A.A. Wragg; Effects of Process Conditions and Electrode Material on Reaction Pathways for Carbon Dioxide Electroreduction with Particular Reference to Formate Formation; Journal of Applied Electrochemistry 33: pp. 1107-1123, 2003; © 2003 Kluwer Academic Publishers. Printed in the Netherlands.
Akahori, Iwanaga, Kato, Hamamoto, Ishii; New Electrochemical Process for CO2 Reduction to from Formic Acid from Combustion Flue Gases; Electrochemistry; vol. 4; pp. 266-270.
Ali, Sato, Mizukawa, Tsuge, Haga, Tanaka; Selective formation of HCO2- and C2O42-in electrochemical reduction of CO2 catalyzed

(56) References Cited

OTHER PUBLICATIONS by mono- and di-nuclear ruthenium complexes; Chemistry Communication; 1998; Received in Cambridge, UK, Oct. 13, 1997; 7/07363A; pp. 249-250.
Wang, Maeda, Thomas, Takanabe, Xin, Carlsson, Domen, Antonietti; A metal-free polymeric photocatalyst for hydrogen production from water under visible light; Nature Materials; Published Online Nov. 9, 2008; www.nature.com/naturematerials; pp. 1-5.
Aresta and Dibenedetto; Utilisation of CO2 as a Chemical Feedstock: Opportunities and Challenges; Dalton Transactions; 2007; pp. 2975-2992; © The Royal Society of Chemistry 2007.
B. Aurian-Blajeni, I. Taniguchi, and J. O'M. Bockris; Photoelectrochemical Reduction of Carbon Dioxide Using Polyaniline-Coated Silicon; J. Electroanal. Chem.; vol. 149; 1983; pp. 291-293; Elsevier Sequoia S.A., Lausanne, Printed in the Netherlands.
Azuma, Hashimoto, Hiramoto, Watanabe, Sakata; Electrochemical Reduction of Carbon Dioxide on Various Metal Electrodes in Low-Temperature Aqueous KHCO3 Media; J. Electrochem. Soc., vol. 137, No. 6, Jun. 1990 © The Electrochemical Society, Inc.
Bandi and Kuhne; Electrochemical Reduction of Carbon Dioxide in Water: Analysis of Reaction Mechanism on Ruthenium—Titanium—Oxide; J. Electrochem. Soc., vol. 139, No. 6, Jun. 1992 © The Electrochemicl Society, Inc.
Beley, Collin, Sauvage, Petit, Chartier; Photoassisted Electro-Reduction of CO2 on p-GaAs in the Presence of Ni Cyclam; J. Electroanal. Chem. vol. 206, 1986, pp. 333-339, Elsevier Sequoia S.A., Lausanne, Printed in the Netherlands.
Benson, Kubiak, Sathrum, and Smieja; Electrocatalytic and homogeneous approaches to conversion of CO2 to liquid fuels; Chem. Soc. Rev., 2009, vol. 38, pp. 89-99, © The Royal Society of Chemistry 2009.
Taniguchi, Adrian-Blajeni, and Bockris; The Mediation of the Photoelectrochemical Reduction of Carbon Dioxide by Ammonium Ions; J. Electroanal. Chem., vol. 161, 1984, pp. 385-388, Elsevier Sequoia S.A., Lausanne—Printed in the Netherlands.
Bockris and Wass; The Photoelectrocatalytic Reduction of Carbon Dioxide; J. Electrochem. Soc., vol. 136, No. 9, Sep. 1989, pp. 2521-2528, © The Electrochemical Society, Inc.
Carlos R. Cabrera and Hector D. Abruna; Electrocatalysis of CO2 Reduction at Surface Modified Metallic and Semiconducting Electrodes; J. Electroanal. Chem. vol. 209, 1986, pp. 101-107, Elesevier Sequoia S.A., Lausanne—Printed in the Netherlands, © 1986 Elsevier Sequoia S.A.
D. Canfield and K.W. Frese, Jr.; Reduction of Carbon Dioxide to Methanol on n- and p-GaAs and p-InP. Effect of Crystal Face, Electrolyte and Current Density; Journal of the Electrochemical Society; Aug. 1983; pp. 1772-1773.
Huang, Lu, Zhao, Li, and Wang; The Catalytic Role of N-Heterocyclic Carbene in a Metal-Free Conversion of Carbon Dioxide into Methanol: A Computational Mechanism Study; J. Am. Chem. Soc. 2010, vol. 132, pp. 12388-12396, © 2010 American Chemical Society.
Arakawa, et al., Catalysis Research of Relevance to Carbon Management: Progress, Challenges, and Opportunities; Chem. Rev. 2001, vol. 101, pp. 953-996.
Cheng, Blaine, Hill, and Mann; Electrochemical and IR Spectroelectrochemical Studies of the Electrocatalytic Reduction of Carbon Dioxide by [Ir2(dimen)4]2+ (dimen = 1,8-Diisocyanomenthane), Inorg. Chem. 1996, vol. 35, pp. 7704-7708, © 1996 American Chemical Society.
Stephen K. Ritter; What Can We Do With Carbon Dioxide?, Chemical & Engineering News, Apr. 30, 2007, vol. 85, No. 18, pp. 11-17, http://pubs.acs.org/cen/coverstory/85/8518cover.html.
J. Beck, R. Johnson, and T. Naya; Electrochemical Conversion of Carbon Dioxide to Hydrocarbon Fuels, EME 580 Spring 2010, pp. 1-42.
Aydin and Koleli, Electrochemical reduction of CO2 on a polyaniline electrode under ambient conditions and at high pressure in methanol, Journal of Electroanalytical Chemistry vol. 535 (2002) pp. 107-112, www.elsevier.com/locate/jelechem.
Lee, Kwon, Machunda, and Lee; Electrocatalytic Recycling of CO2 and Small Organic Molecules; Chem. Asian J. 2009, vol. 4, pp. 1516-1523, © 2009 Wiley-VCH Verlag GmbH&Co. KGaA, Weinheim.
Etsuko Fujita, Photochemical CO2 Reduction: Current Status and Future Prospects, American Chemical Society's New York Section, Jan. 15, 2011, pp. 1-29.
Toshio Tanaka, Molecular Orbital Studies on the Two-Electron Reduction of Carbon Dioxide to Give Formate Anion, Memiors of Fukui University of Technology, vol. 23, Part 1, 1993, pp. 223-230.
A. Bewick and G.P. Greener, The Electroreduction of CO2 to Glycollate on a Lead Cathode, Tetrahedron Letters No. 5, pp. 391-394, 1970, Pergamon Press, Printed in Great Britain.
Centi, Perathoner, Wine, and Gangeri, Electrocatalytic conversion of CO2 to long carbon-chain hydrocarbons, Green Chem., 2007, vol. 9, pp. 671-678, © The Royal Society of Chemistry 2007.
A. Bewick and G.P. Greener, The Electroreduction of CO2 to Malate on a Mercury Cathode, Tetrahedron Letters No. 53, pp. 4623-4626, 1969, Pergamon Press, Printed in Great Britain.
Eggins, Brown, McNeill, and Grimshaw, Carbon Dioxide Fixation by Electrochemical Reduction in Water to Oxalate and Glyoxylate, Tetrahedron Letters vol. 29, No. 8, pp. 945-948, 1988, Pergamon Journals Ltd., Printed in Great Britain.
Hori, Kikuchi, and Suzuki; Production of CO and CH4 in Electrochemical Reduction of CO2 at Metal Electrodes in Aqueous Hydrogencarbonate Solution; Chemistry Letters, pp. 1695-1698, 1985. (C) 1985 The Chemical Society of Japan.
Jitaru, Lowy, M. Toma, B.C. Toma, Oniciu; Electrochemical reduction of carbon dioxide on flat metallic cathodes; Journal of Applied Electrochemistry 27 (1997) pp. 875-889, Reviews in Applied Electrochemistry No. 45.
Kaneco, Iwao, Iiba, Itoh, Ohta, and Mizuno; Electrochemical Reduction of Carbon Dioxide on an Indium Wire in a KOH/Methanol-Based Electrolyte at Ambient Temperature and Pressure; Environmental Engineering Science; vol. 16, No. 2, 1999, pp. 131-138.
Todoroki, Hara, Kudo, and Sakata; Electrochemical reduction of high pressure CO2 at Pb, Hg and in electrodes in an aqueous KHCO3 solution; Journal of Electroanalytical Chemistry 394 (1995) 199-203.
R.P.S. Chaplin and A.A. Wragg, Effects of process conditions and electrode material on reaction pathways for carbon dioxide electroreduction with particular reference to formate formation, Journal of Applied Electrochemistry 33: 1107-1123, 2003, Copyright 2003 Kluwer Academic Publishers. Printed in the Netherlands.
Kapusta and Hackerman; The Electroreduction of Carbon Dioxide and Formic Acid on Tin and Indium Electrodes, J. Electrochem. Doc.: Electrochemical Science and Technology, vol. 130, No. 3 Mar. 1983, pp. 607-613.
M. N. Mahmood, D. Masheder, and C. J. Harty; Use of gas-diffusion electrodes for high-rate electrochemical reduction of carbon dioxide. I. Reduction at lead, indium- and tin-impregnated electrodes; Journal of Applied Electrochemistry 17 (1987) 1159-1170.
Y. Hori, Electrochemical CO2 Reduction on Metal Electrodes, Modern Aspects of Electrochemistry, No. 42, edited by C. Vayenas et al., Springer, New York, 2008, pp. 89-189.
Yoshio Hori, Hidetoshi Wakebe, Toshio Tsukamoto and Osamu Koga; Electrocatalytic Process of CO Selectivity in Electrochemical Reductionof CO2 at Metal Electrodes in Aqueous Media; Electrochimica Acta, vol. 39, No. 11/12, pp. 1833-1839, 1994, Copyright 1994 Elsevier Science Ltd., Printed in Great Britain.
Noda, Ikeda, Oda, Imai, Maeda, and Ito; Electrochemical Reduction of Carbon Dioxide at Various Metal Electrodes in Aqueous Potassium Hydrogen Carbonate Solution; Bull. Chem. Soc. Jpn., 63, 2459-2462, 1990, Copyright 1990 The Chemical Society of Japan.
Azuma, Hashimoto, Hiramoto, Watanbe, and Sakata; Carbon dioxide reduction at low temperature on various metal electrodes; J. Electroanal. Chem., 260 (1989) 441-445, Elsevier Sequoia S.A., Lausanne—Printed in The Netherlands.
Vassiliev, Bagotzky, Khazova, and Mayorova; Electroreduction of Carbon Dioxide, Part II. The Mechanism of Reduction in Aprotic

(56) References Cited

OTHER PUBLICATIONS

Solvents, J. Electroanal. Chem. 189 (1985) 295-309, Elsevier Sequoia S.A., Lausanne—Printed in the Netherlands.
Vassiliev, Bagotzky, Khazova, and Mayorova; Electroreduction of Carbon Dioxide, Part I. The Mechanism and Kinetics of Electroreduction of CO2 in Aqueous Solutions on Metals with High and Moderate Hydrogen Overvoltages, J. Electroanal. Chem. 189 (1985) 271-294, Elsevier Sequoia S.A., Lausanne—Printed in the Netherlands.
Ikeda, Takagi, and Ito; Selective Formation of Formic Acid, Oxalic Acid, and Carbon Monoxide by Electrochemical Reduction of Carbon Dioxide, Bull. Chem. Soc. Jpn., 60, 2517-2522.
Shibata, Yoshida, and Furuya; Electrochemical Synthesis of Urea at Gas-Diffusion Electrodes, IV. Simultaneous Reduction of Carbon Dioxide and Nitrate Ions with Various Metal Catalysts; J. Electrochem. Soc., vol. 145, No. 7, Jul. 1998 The Electrochemical Society, Inc., pp. 2348-2353.
F. Richard Keene, Electrochemical and Electrocatalytic Reactions of Carbon Dioxide—Chapter 1: Thermodynamic, Kinetic, and Product Considerations in Carbon Dioxide Reactivity, Elsevier, Amsterdam, 1993, pp. 1-17.
Sammells and Cook, Electrochemical and Electrocatalytic Reactions of Carbon Dioxide—Chapter 7: Electrocatalysis and Novel Electrodes for High Rate CO2 Reduction Under Ambient Conditions, Elsevier, Amsterdam, 1993, pp. 217-262.
W.W. Frese, Jr., Electrochemical and Electrocatalytic Reactions of Carbon Dioxide—Chapter 6: Electrochemical Reduction of CO2 at Solid Electrodes, Elsevier, Amsterdam, 1993, pp. 145-215.
Halmann and Steinberg, Greenhouse gas carbon dioxide mitigation: science and technology—Chapter 11: Photochemical and Radiation-Induced Activation of CO2 in Homogeneous Media, CRC Press, 1999, pp. 391-410.
Halmann and Steinberg, Greenhouse gas carbon dioxide mitigation: science and technology—Chapter 12: Electrochemical Reduction of CO2, CRC Press, 1999, pp. 411-515.
Halmann and Steinberg, Greenhouse gas carbon dioxide mitigation: science and technology—Chapter 13: Photoelectrochemical Reduction of CO2, CRC Press, 1999, pp. 517-527.
Colin Oloman and Hui Li, Electrochemical Processing of Carbon Dioxide, ChemSusChem 2008, 1, 385-391, Copyright 2008 Wiley-VCH Verlag GmbH& Co. KGaA, Weinheim, www.chemsuschem.org.
Hui Li and Colin Oloman, Development of a continuous reactor for the electro-reduction of carbon dioxide to formate—Part 1: Process variables, Journal of Applied Electrochemistry (2006) 36:1105-1115, Copyright Springer 2006.
Hui Li and Colin Oloman, Development of a continuous reactor for the electro-reduction of carbon dioxide to formate—Part 2: Scale-up, J Appl Electrochem (2007) 37:1107-1117.
Hui Li and Colin Oloman, The electro-reduction of carbon dioxide in a continuous reactor, Journal of Applied Electrochemistry (2005) 35:955-965, Copyright Springer 2005.
PCT International Search Report dated Dec. 13, 2011, PCT/US11/45515, 2 pages.
Andrew P. Doherty, Electrochemical reduction of butraldehyde in the presence of CO2, Electrochimica Acta 47 (2002) 2963-2967, Copyright 2002 Elsevier Science Ltd.
Seshadri, Lin, and Bocarsly; A new homogeneous electrocatalyst for the reduction of carbon dioxide to methanol at low overpotential; Journal of Electroanalytical Chemistry, 372 (1994) 145-150.
PCT International Search Report dated Dec. 15, 2011, PCT/US11/45521, 2 pages.
Fan et al., Semiconductor Electrodes. 27. The p- and n-GaAs-N, N?—Dimet h y1-4,4'-bipyridinium System. Enhancement of Hydrogen Evolution on p-GaAs and Stabilization of n-GaAs Electrodes, Journal of the American Chemical Society, vol. 102, Feb. 27, 1980, pp. 1488-1492.
PCT International Search Report dated Jun. 23, 2010, PCT/US10/22594, 2 pages.
Emily Barton Cole and Andrew B. Bocarsly, Carbon Dioxide as Chemical Feedstock, Chapter 11—Photochemical, Electrochemical, and Photoelectrochemical Reduction of Carbon Dioxide, Copyright 2010 Wiley-VCH Verlag GmbH & Co. KGaA, Weinheim, 26 pages.
Barton Cole, Lakkaraju, Rampulla, Morris, Abelev, and Bocarsly; Using a One-Electron Shuttle for the Multielectron Reduction of CO2 to Methanol: Kinetic, Mechanistic, and Structural Insights; Mar. 29, 2010, 13 pages.
Morris, McGibbon, and Bocarsly; Electrocatalytic Carbon Dioxide Activation: The Rate-Determining Step of Pyridinium-Catalyzed CO2 Reduction; ChemSusChem 2011, 4, 191-196, Copyright 2011 Wiley-VCH Verlag GmbH& Co. KGaA, Weinheim.
Emily Barton Cole, Pyridinium-Catalyzed Electrochemical and Photoelectrochemical Conversion of CO2 to Fuels: A Dissertation Presented to the Faculty of Princeton University in Candidacy for the Degree of Doctor of Philosophy, Nov. 2009, pp. 1-141.
Barton, Rampulla, and Bocarsly; Selective Solar-Driven Reduction of CO2 to Methanol Using a Catalyzed p-GaP Based Photoelectrochemical Cell; Oct. 3, 2007, 3 pages.
Mostafa Hossain, Nagaoka, and Ogura; Palladium and cobalt complexes of substituted quinoline, bipyridine and phenanthroline as catalysts for electrochemical reduction of carbon dioxide; Electrochimica Acta, vol. 42, No. 16, pp. 2577-2585, 1997.
Keene, Creutz, and Sutin; Reduction of Carbon Dioxide by TRIS(2,2'-Bipyridine)Cobalt(I), Coordination Chemistry Reviews, 64 (1995) 247-260, Elsevier Science Publishers B.V., Amsterdam—Printed in the Netherlands.
Aurian-Blajeni, Halmann, and Manassen; Electrochemical Measurements on the Photoelectrochemical Reduction of Aqueous Carbon Dioxide on p-Gallium Phosphide and p-Gallium Arsenide Semiconductor Electrodes, Solar Energy Materials 8 (1983) 425-440, North-Holland Publishing Company.
Tan, Zou, and Hu; Photocatalytic reduction of carbon dioxide into gaseous hydrocarbon using TiO2 pellets; Catalysis Today 115 (2006) 269-273.
Bandi and Kuhne, Electrochemical Reduction of Carbon Dioxide in Water: Analysis of Reaction Mechanism on Ruthenium-Titanium-Oxide, J. Electrochem. Soc., vol. 139, No. 6, Jun. 1992 (C) The Electrochemical Society, Inc., pp. 1605-1610.
B. Beden, A. Bewick and C. Lamy, A Study by Electrochemically Modulated Infrared Reflectance Spectroscopy of the Electrosorption of Formic Acid at a Platinum Electrode, J. Electroanal. Chem., 148 (1983) 147-160, Elsevier Sequoia S.A., Lausanne—Printed in the Netherlands.
Bell and Evans, Kinetics of the Dehydration of Methylene Glycol in Aqueous Solution, Proceedings of the Royal Society of London, Series A, Mathematical and Physical Sciences, vol. 291, No. 1426 (Apr. 26, 1966), pp. 297-323.
Bian, Sumi, Furue, Sato, Kolke, and Ishitani; A Novel Tripodal Ligand, Tris[(4'-methy1-2,2'-bipyridy1-4-yl)-methyl]carbinol and Its Trinuclear Rull/Rel Mixed-Metal Complexes: Synthesis, Emission Properties, and Photocatalytic CO2 Reduction; Inorganic Chemistry, vol. 47, No. 23, 2008, pp. 10801-10803.
T. Bundgaard, H. J. Jakobsen, and E. J. Rahkamaa; A High-Resolution Investigation of Proton Coupled and Decoupled 13C FT NMR Spectra of 15N-Pyrrole; Journal of Magnetic Resonance 19,345-356 (1975).
D. Canfield and K. W. Frese, Jr, Reduction of Carbon Dioxide to Methanol on n- and p-GaAs and p-InP. Effect of Crystal Face, Electrolyte and Current Density, Journal of the Electrochemical Society, vol. 130, No. 8, Aug. 1983, pp. 1772-1773.
Arakawa, et al., Catalysis Research of Relevance to Carbon Management: Progress, Challenges, and Opportunities, Chem. Rev. 2001, 101, 953-996.
Chang, Ho, and Weaver; Applications of real-time infrared spectroscopy to electrocatalysis at bimetallic surfaces, I. Electrooxidation of formic acid and methanol on bismuth-modified Pt(111) and Pt(100), Surface Science 265 (1992) 81-94.
S. Clarke and J. A. Harrison, The Reduction of Formaldehyde, Electroanalytical Chemistry and Interfacial Electrochemistry, J. Electroanal. Chem., 36 (1972), pp. 109-115, Elsevier Sequoia S.A., Lausanne Printed in the Netherlands.

(56) References Cited

OTHER PUBLICATIONS

Li, Markley, Mohan, Rodriguez-Santiago, Thompson, and Van Niekerk; Utilization of Carbon Dioxide From Coal-Fired Power Plant for the Production of Value-Added Products; Apr. 27, 2006, 109 pages.
Cook, MacDuff, and Sammells; High Rate Gas Phase CO2 Reduction to Ethylene and Methane Using Gas Diffusion Electrodes, J. Electrochem. Soc., vol. 137, No. 2, pp. 607-608, Feb. 1990, © The Electrochemical Society, Inc.
Daube, Harrison, Mallouk, Ricco, Chao, Wrighton, Hendrickson, and Drube; Electrode-Confined Catalyst Systems for Use in Optical-to-Chemical Energy Conversion; Journal of Photochemistry, vol. 29, 1985, pp. 71-88.
Dewulf, Jin, and Bard; Electrochemical and Surface Studies of Carbon Dioxide Reduction to Methane and Ethylene at Copper Electrodes in Aqueous Solutions; J. Electrochem. Soc., vol. 136, No. 6, Jun. 1989, pp. 1686-1691, © The Electrochemical Society, Inc.
J. Augustynski, P. Kedzierzawski, and B. Jermann, Electrochemical Reduction of CO2 at Metallic Electrodes, Studies in Surface Science and Catalysis, vol. 114, pp. 107-116, © 1998 Elsevier Science B.V.
Sung-Woo Lee, Jea-Keun Lee, Kyoung-Hag Lee, and Jun-Heok Lim, Electrochemical reduction of CO and H2 from carbon dioxide in aqua-solution, Current Applied Physics, vol. 10, 2010, pp. S51-S54.
Andrew P. Abbott and Christopher A. Eardley, Electrochemical Reduction of CO2 in a Mixed Supercritical Fluid, J. Phys. Chem. B, 2000, vol. 104, pp. 775-779.
Matthew R. Hudson, Electrochemical Reduction of Carbon Dioxide, Dec. 9, 2005, pp. 1-15.
S. Kapusta and N. Hackerman, The Electroreduction of Carbon Dioxide and Formic Acid on Tin and Indium Electrodes, J. Electrochem. Soc.: Electrochemical Science and Technology, Mar. 1983, pp. 607-613.
M Aulice Scibioh and B Viswanathan, Electrochemical Reduction of Carbon Dioxide: A Status Report, Proc Indian Natn Sci Acad, vol. 70, A, No. 3, May 2004, pp. 1-56.
N. L. Weinberg, D. J. Mazur, Electrochemical hydrodimerization of formaldehyde to ethylene glycol, Journal of Applied Electrochemistry, vol. 21, 1991, pp. 895-901.
R.P.S. Chaplin and A.A. Wragg, Effects of process conditions and electrode material on reaction pathways for carbon dioxide electroreduction with particular reference to formate formation, Journal of Applied Electrochemistry vol. 33, pp. 1107-1123, 2003, © 2003 Kluwer Academic Publishers. Printed in the Netherlands.
M.N. Mahmood, D. Masheder, and C.J. Harty, Use of gas-diffusion electrodes for high-rate electrochemical reduction of carbon dioxide. I. Reduction at lead, indium- and tin-impregnated electrodes, Journal of Applied Electrochemistry, vol. 17, 1987, pp. 1159-1170.
Summers, Leach, and Frese, The Electrochemical Reduction of Aqueous Carbon Dioxide to Methanol at Molybdenum Electrodes with Low Overpotentials, J. Electroanal. Chem., vol. 205, 1986, pp. 219-232, Elseiver Sequoia S.A., Lausanne—Printed in the Netherlands.
Frese and Leach, Electrochemical Reduction of Carbon Dioxide to Methane, Methanol, and CO on Ru Electrodes, Journal of the Electrochemical Society, Jan. 1985, pp. 259-260.
Frese and Canfield, Reduction of CO2 on n-GaAs Electrodes and Selective Methanol Synthesis, J. Electrochem. Soc.: Electrochemical Science and Technology, vol. 131, No. 11, Nov. 1984, pp. 2518-2522.
Shibata, Yoshida, and Furuya, Electrochemical Synthesis of Urea at Gas-Diffusion Electrodes, J. Electrochem. Soc., vol. 145, No. 2, Feb. 1998, © The Electrochemical Society, Inc., pp. 595-600.
Shibata and Furuya, Simultaneous reduction of carbon dioxide and nitrate ions at gas-diffusion electrodes with various metallophthalocyanine catalysts, Electrochimica Acta 48, 2003, pp. 3953-3958.
M. Gattrell, N. Gupta, and A. Co, A Review of the aqueous electrochemical reduction of CO2 to hydrocarbons at copper, Journal of Electroanalytical Chemistry, vol. 594, 2006, pp. 1-19.
Mahmood, Masheder, and Harty; Use of Gas-Diffusion Electrodes for High-Rate Electrochemical Reduction of Carbon Dioxide. II. Reduction at Metal Phthalocyanine-impregnated Electrodes; Journal of Applied Electrochemistry, vol. 17, 1987, pp. 1223-1227.
Gennaro, Isse, Saveant, Severin, and Vianello; Homogeneous Electron Transfer Catalysis of the Electrochemical Reduction of Carbon Dioxide. Do Aromatic Anion Radicals React in an Outer-Sphere Manner?; J. Am. Chem. Soc., 1996, vol. 118, pp. 7190-7196.
J. Giner, Electrochemical Reduction of CO2 on Platinum Electrodes in Acid Solutions, Electrochimica Acta, 1963, vol. 8, pp. 857-865, Pregamon Press Ltd., Printed in Northern Ireland.
John Leonard Haan, Electrochemistry of Formic Acid and Carbon Dioxide on Metal Electrodes with Applications to Fuel Cells and Carbon Dioxide Conversion Devices, 2010, pp. 1-205.
M. Halmann, Photoelectrochemical reduction of aqueous carbon dioxide on p-type gallium phosphide in liquid junction solar cells, Nature, vol. 275, Sep. 14, 1978, pp. 115-116.
H. Ezaki, M. Morinaga, and S. Watanabe, Hydrogen Overpotential for Transition Metals and Alloys, and its Interpretation Using an Electronic Model, Electrochimica Acta, vol. 38, No. 4, 1993, pp. 557-564, Pergamon Press Ltd., Printed in Great Britain.
K.S. Udupa, G.S. Subramanian, and H.V.K. Udupa, The Electrolytic Reduction of Carbon Dioxide to Formic Acid, Electrochimica Acta, 1971, vol. 16, pp. 1593-1598, Pergamon Press., Printed in Northern Ireland.
Ougitani, Aizawa, Sonoyama, and Sakata; Temperature Dependence of the Probability of Chain Growth for Hydrocarbon Formation by Electrochemical Reduction of CO2, Bull. Chem. Soc. Jpn., vol. 74, pp. 2119-2122, 2001.
Furuya, Yamazaki, and Shibata; High performance Ru-Pd catalysts for CO2 reduction at gas-diffusion electrodes, Journal of Electroanalytical Chemistry, vol. 431, 1997, pp. 39-41.
R. Hinogami, Y. Nakamura, S. Yae, and Y. Nakato; An Approach to Ideal Semiconductor Electrodes for Efficient Photoelectrochemical Reduction of Carbon Dioxide by Modification with Small Metal Particles, J. Phys. Chem. B, 1998, vol. 102, pp. 974-980.
Reda, Plugge, Abram, and Hirst; Reversible interconversion of carbon dioxide and formate by an electroactive enzyme, PNAS, Aug. 5, 2008, vol. 105, No. 31, pp. 10654-10658, www.pnas.org/cgi/doi/10.1073pnas.0801290105.
Hori, Yoshio; Suzuki, Shin, Cathodic Reduction of Carbon Dioxide for Energy Storage, Journal of the Research Institute for Catalysis Hokkaido University, 30(2): 81-88, Feb. 1983, http://hdl.handle.net/2115/25131.
Hori, Wakebe, Tsukamoto, and Koga; Electrocatalytic Process of CO Selectivity in Electrochemical Reduction of CO2 at Metal Electrodes in Aqueous Media, Electrochimica Acta, vol. 39, No. 11/12, pp. 1833-1839, 1994, Copyright 1994 Elsevier Science Ltd.,Pergamon, Printed in Great Britain.
Hori, Kikuchi, and Suzuki; Production of CO and CH4 in Electrochemical Reduction of CO2 at Metal Electrodes in Aqueous Hydrogencarbonate Solution; Chemistry Letters, 1985, pp. 1695-1698, Copyright 1985 The Chemical Society of Japan.
Hori, Kikuchi, Murata, and Suzuki; Production of Methane and Ethylene in Electrochemical Reduction of Carbon Dioxide at Copper Electrode in Aqueous Hydrogencarbonate Solution; Chemistry Letters, 1986, pp. 897-898, Copyright 1986 The Chemical Society of Japan.
Hoshi, Suzuki, and Hori; Step Density Dependence of CO2 Reduction Rate on Pt(S)-[n(111) x (111)] Single Crystal Electrodes, Electrochimica Acta, vol. 41, No. 10, pp. 1617-1653, 1996, Copyright 1996 Elsevier Science Ltd. Printed in Great Britain.
Hoshi, Suzuki, and Hori; Catalytic Activity of CO2 Reduction on Pt Single-Crystal Electrodes: Pt(S)-[n(111)x(111)], Pt(S)-[n(111)x(100)], and Pt(S)-[n(100)x(111)], J. Phys. Chem. B, 1997, vol. 101, pp. 8520-8524.
Ikeda, Saito, Yoshida, Noda, Maeda, and Ito; Photoelectrochemical reduction products of carbon dioxide at metal coated p-GaP photocathodes in non-aqueous electrolytes, J. Electroanal. Chem., 260 (1989) pp. 335-345, Elsevier Sequoia S.A., Lausanne—Printed in the Netherlands.
Noda, Ikeda, Oda, Imai, Maeda, and Ito; Electrochemical Reduction of Carbon Dioxide at Various Metal Electrodes in Aqueous Potassium Hydrogen Carbonate Solution, Bull. Chem. Soc. Jpn., 63, pp. 2459-2462, 1990, Copyright 1990 The Chemical Society of Japan.

(56) References Cited

OTHER PUBLICATIONS

S.R. Narayanan, B. Haines, J. Soler, and T.I. Valdez; Electrochemical Conversion of Carbon Dioxide to Formate in Alkaline Polymer Electrolyte Membrane Cells, Journal of the Electrochemical Society, 158 (2) A167-A173 (2011).
Tooru Inoue, Photoelectrocatalytic reduction of carbon dioxide in aqueous suspensions of semiconductor powders, Nature, vol. 277, Feb. 22, 1979, pp. 637-638.
B. Jermann and J. Augustynski, Long-Term Activation of the Copper Cathode in the Course of CO2 Reduction, Electrochimica Acta, vol. 39, No. 11/12, pp. 1891-1896, 1994, Elsevier Science Ltd., Printed in Great Britain.
Jitaru, Lowy, M. Toma, B.C. Toma, and L. Oniciu; Electrochemical reduction of carbon dioxide on flat metallic cathodes; Journal of Applied Electrochemistry 27 (1997) 875-889, Reviews in Applied Electrochemistry No. 45.
Maria Jitaru, Electrochemical Carbon Dioxide Reduction-Fundamental and Applied Topics (Review), Journal of the University of Chemical Technology and Metallurgy, 42, 4, 2007, 333-344.
Kaneco, Katsumata, Suzuki, and Ohta; Photoelectrocatalytic reduction of CO2 in LiOH/methanol at metal-modified p-InP electrodes, Applied Catalysis B: Environmental 64 (2006) 139-145.
J.J. Kim, D.P. Summers, and K.W. Frese, Jr; Reduction of CO2 and CO to Methane on Cu Foil Electrodes, J. Electroanal. Chem., 245 (1988) 223-244, Elsevier Sequoia S.A., Lausanne—Printed in the Netherlands.
Osamu Koga and Yoshio Hori, Reduction of Adsorbed CO on a Ni Electrode in Connection With the Electrochemical Reduction of CO2, Electrochimica Acta, vol. 38, No. 10, pp. 1391-1394,1993, Printed in Great Britain.
Breedlove, Ferrence, Washington, and Kubiak; A photoelectrochemical approach to splitting carbon dioxide for a manned mission to Mars, Materials and Design 22 (2001) 577-584, © 2001 Elsevier Science Ltd.
Simon-Manso and Kubiak, Dinuclear Nickel Complexes as Catalysts for Electrochemical Reduction of Carbon Dioxide, Organometallics 2005, 24, pp. 96-102, © 2005 American Chemical Society.
Kushi, Nagao, Nishioka, Isobe, and Tanaka; Remarkable Decrease in Overpotential of Oxalate Formation in Electrochemical C02 Reduction by a Metal-Sulfide Cluster, J. Chem. Soc., Chem. Commun., 1995, pp. 1223-1224.
Kuwabata, Nishida, Tsuda, Inoue, and Yoneyama; Photochemical Reduction of Carbon Dioxide to Methanol Using ZnS Microcrystallite as a Photocatalyst in the Presence of Methanol Dehydrogenase, J. Electrochem. Soc., vol. 141, No. 6, pp. 1498-1503, Jun. 1994, © The Electrochemical Society, Inc.
Jean-Marie Lehn and Raymond Ziessel, Photochemical generation of carbon monoxide and hydrogen by reduction of carbon dioxide and water under visible light irradiation, Proc. Natl. Acad. Sci. USA, vol. 79, pp. 701-704, Jan. 1982, Chemistry.
Azuma, Hashimoto, Hiramoto, Watanabe, and Sakata; Carbon dioxide reduction at low temperature on various metal electrodes, J. Electroanal. Chem., 260 (1989) 441-445, Elsevier Sequoia S.A., Lausanne—Printed in The Netherlands.
Goettmann, Thomas, and Antonietti; Metal-Free Activation of CO2 by Mesoporous Graphitic Carbon Nitride; Angewandte Chemie; Angew. Chem. Int. Ed. 2007, 46, 2717-2720.
Yu B Vassiliev, V S Bagotzky, O.A. Khazova and Na Mayorova; Electroreduction of Carbon Dioxide Part II. The Mechanism of Reduction in Aprotic Solvents, J Electroanal. Chem, 189 (1985) 295-309 Elsevier Sequoia S.A. , Lausanne—Printed in the Netherlands.
Whipple, Finke, and Kenis; Microfluidic Reactor for the Electrochemical Reduction of Carbon Dioxide: The Effect of pH; Electrochemical and Solid-State Letters, 13 (9) B109-B111 (2010), 1099-0062/2010/13(9)/B109/3/$28.00 © The Electrochemical Society.
Zhai, Chiachiarelli, and Sridhar; Effects of Gaseous Impurities on the Electrochemical Reduction of CO2 on Copper Electrodes; ECS Transactions, 19 (14) 1-13 (2009), 10.1149/1.3220175 © The Electrochemical Society.
R.D.L. Smith, P.G. Pickup, Nitrogen-rich polymers for the electrocatalytic reduction of CO2, Electrochem. Commun. (2010), doi:10.1016/j.elecom.2010.10.013.
B.Z. Nikolic, H. Huang, D. Gervasio, A. Lin, C. Fierro, R.R. Adzic, and E.B. Yeager; Electroreduction of carbon dioxide on platinum single crystal electrodes: electrochemical and in situ FTIR studies; J. Electmanal. Chem., 295 (1990) 415-423; Elsevier Sequoia S.A., Lausanne.
Nogami, Itagaki, and Shiratsuchi; Pulsed Electroreduction of CO2 on Copper Electrodes-II; J. Electrochem. Soc., vol. 141, No. 5, May 1994 © The Electrochemical Society, Inc., pp. 1138-1142.
Ichiro Oda, Hirohito Ogasawara, and Masatoki Ito; Carbon Monoxide Adsorption on Copper and Silver Electrodes during Carbon Dioxide Electroreduction Studied by Infrared Reflection Absorption Spectroscopy and Surface-Enhanced Raman Spectroscopy; Langmuir 1996, 12, 1094-1097.
Kotaro Ogura,, Kenichi Mine, Jun Yano, and Hideaki Sugihara; Electrocatalytic Generation of C2 and C3 Compounds from Carbon Dioxide on a Cobalt Complex-immobilized Dual-film Electrode; J . Chem. Soc., Chem. Commun., 1993, pp. 20-21.
Ohkawa, Noguchi, Nakayama, Hashimoto, and Fujishima; Electrochemical reduction of carbon dioxide on hydrogen-storing materials Part 3. The effect of the absorption of hydrogen on the palladium electrodes modified with copper; Journal of Electroanalytical Chemistry, 367 (1994) 165-173.
Sanchez-Sanchez, Montiel, Tryk, Aldaz, and Fujishima; Electrochemical approaches to alleviation of the problem of carbon dioxide accumulation; Pure Appl. Chem., vol. 73, No. 12, pp. 1917-1927, 2001, © 2001 IUPAC.
D. J. Pickett and K. S. Yap, A study of the production of glyoxylic acid by the electrochemical reduction of oxalic acid solutions, Journal of Applied Electrochemistry 4 (1974) 17-23, Printed in Great Britain, © 1974 Chapman and Hall Ltd.
Bruce A. Parkinson & Paul F. Weaver, Photoelectrochemical pumping of enzymatic CO2 reduction, Nature, vol. 309, May 10, 1984, pp. 148-149.
Paul, Tyagi, Bilakhiya, Bhadbhade, Suresh, and Ramachandraiah; Synthesis and Characterization of Rhodium Complexes Containing 2,4,6-Tris(2-pyridyl)-1,3,5-triazine and Its Metal-Promoted Hydrolytic Products: Potential Uses of the New Complexes in Electrocatalytic Reduction of Carbon Dioxide; Inorg. Chem. 1998, 37, 5733-5742.
Furuya, Yamazaki, and Shibata; High performance Ru-Pd catalysts for CO2 reduction at gas-diffusion electrodes, Journal of Electroanalytical Chemistry 431 (1997) 39-41.
Petit, Chartier, Beley, and Deville; Molecular catalysts in photoelectrochemical cells Study of an efficient system for the selective photoelectroreduction of CO2: p-GaP or p-GaAs / Ni( cyclam) 2+, aqueous medium; J. Electroanal. Chem., 269 (1989) 267-281; Elsevier Sequoia S.A., Lausanne—Printed in the Netherlands.
Popic, Avramov-Ivic, and Vukovic; Reduction of carbon dioxide on ruthenium oxide and modified ruthenium oxide electrodes in 0.5 M NaHCO3, Journal of Electroanalytical Chemistry 421 (1997) 105-110.
Whipple and Kenis, Prospects of CO2 Utilization via Direct Heterogeneous Electrochemical Reduction, J. Phys. Chem. Lett. 2010, 1, 3451-3458, © 2010 American Chemical Society.
P.A. Christensen & S.J. Higgins, Preliminary note the electrochemical reduction of CO2 to oxalate at a Pt electrode immersed in acetonitrile and coated with polyvinylalcohol/[Ni(dppm)2CI2], Journal of Electroanalytical Chemistry, 387 (1995) 127-132.
Qu, Zhang, Wang, and Xie; Electrochemical reduction of CO2 on RuO2/TiO2 nanotubes composite modified Pt electrode, Electrochimica Acta 50 (2005) 3576-3580.
Jin, Gao, Jin, Zhang, Cao, ; Wei, and Smith; High-yield reduction of carbon dioxide into formic acid by zero-valent metal/metal oxide redox cycles; Energy Environ. Sci., 2011, 4, pp. 881-884.
Yu B Vassiliev, V S Bagotzky. N V Osetrova and A A Mikhailova; Electroreduction of Carbon Dioxide Part IIII. Adsorption and Reduction of CO2 on Platinum Metals; J Electroanal Chem. 189 (1985) 311-324, Elsevier Sequoia SA, Lausanne—Printed in the Netherlands.

(56) References Cited

OTHER PUBLICATIONS

M. Gattrell, N. Gupta, and A. Co; A review of the aqueous electrochemical reduction of CO2 to hydrocarbons at copper; Journal of Electroanalytical Chemistry 594 (2006) 1-19.
Noshi, Ito, Suzuki, and Hori; Preliminary note CO 2 Reduction on Rh single crystal electrodes and the structural effect; Journal of Electroanalytical Chemistry 395 (1995) 309-312.
Rudolph, Dautz, and Jager; Macrocyclic [N42-] Coordinated Nickel Complexes as Catalysts for the Formation of Oxalate by Electrochemical Reduction of Carbon Dioxide; J. Am. Chem. Soc. 2000, 122, 10821-10830, Published on Web Oct. 21, 2000.
Ryu, Andersen, and Eyring; The Electrode Reduction Kinetics of Carbon Dioxide in Aqueous Solution; The Journal of Physical Chemistry, vol. 76, No. 22, 1972, pp. 3278-3286.
Zhao, Jiang, Han, Li, Zhang, Liu, Hi, and Wu; Electrochemical reduction of supercritical carbon dioxide in ionic liquid 1-n-butyl-3-methylimidazolium hexafluorophosphate; J. of Supercritical Fluids 32 (2004) 287-291.
Schwartz, Cook, Kehoe, Macduff, Patel, and Sammells; Carbon Dioxide Reduction to Alcohols using Perovskite-Type Electrocatalysts; J. Electrochem. Soc., vol. 140, No. 3, Mar. 1993 © The Electrochemical Society, Inc., pp. 614-618.
Ikeda, Takagi, and Ito; Selective Formation of Formic Acid, Oxalic Acid, and Carbon Monoxide by Electrochemical Reduction of Carbon Dioxide; Bull. Chem. Soc. Jpn., 60, 2517-2522 (1987) © 1987 The Chemical Society of Japan.
Shiratsuchi, Aikoh, and Nogami; Pulsed Electroreduction of CO2 on Copper Electrodes; J, Electrochem. Soc., vol. 140, No. 12, Dec. 1993 © The Electrochemical Society, Inc.
Centi & Perathoner; Towards Solar Fuels from Water and CO2; ChemSusChem 2010, 3, 195-208, © 2010 Wiley-VCH Verlag GmbH& Co. KGaA, Weinheim.
David P. Summers, Steven Leach and Karl W. Frese Jr.; The Electrochemical Reduction of Aqueous Carbon Dioxide to Methanol at Molybdenum Electrodes With Low Overpotentials; J Electroanal. Chem., 205 (1986) 219-232, Elsevier Sequoia S.A., Lausanne—Printed in the Netherlands.
Isao Taniguchi, Benedict Aurian-Blajeni and John O'M. Bockris; Photo-Aided Reduction of Carbon Dioxide to Carbon Monoxide; J. Electroanal. Chem, 157 (1983) 179-182, Elsevier Sequoia S.A., Lausanne—Printed in the Netherlands.
Isao Taniguchi, Benedict Aurian-Blajeni and John O'M. Bockris; The Mediation of the Photoelectrochemical Reduction of Carbon Dioxide by Ammonium Ions; J. Electroanal. Chem, 161 (1984) 385-388, Elsevier Sequoia S.A., Lausanne—Printed in the Netherlands.
Hiroshi Yoneyama, Kenji Sugimura and Susumu Kuwabata; Effects of Electrolytes on the Photoelectrochemical Reduction of Carbon Dioxide at Illuminated p-Type Cadmium Telluride and p-Type Indium Phosphide Electrodes in Aqueous Solutions; J. Electroanal. Chem., 249 (1988) 143-153, Elsevier Sequoia ,S.A., Lausanne—Printed in the Netherlands.
Whipple, Finke, and Kenis; Microfluidic Reactor for the Electrochemical Reduction of Carbon Dioxide: The Effect of pH; Electrochemical and Solid-State Letters, 13 (9) B109-B111 (2010).
YLB Vassiliev, V S Bagotzky, N V. Osetrov, O.A. Khazova and Na Mayorova; Electroreduction of Carbon Dioxide Part I. The Mechanism and Kinetics of Electroreduction of CO2 in Aqueous Solutions on Metals with High and Moderate Hydrogen Overvoltages; J Electroanal. Chem. 189 (1985) 271-294, Elsevier Sequoia Sa , Lausanne—Printed in the Netherlands.
YLB Vassiliev, V S Bagotzky, N V. Osetrov, O.A. Khazova and Na Mayorova; Electroreduction of Carbon Dioxide Part II. The Mechanism of Reduction in Aprotic Solvents; J Electroanal. Chem. 189 (1985) 295-309, Elsevier Sequoia SA , Lausanne—Printed in the Netherlands.
Watanabe, Shibata, Kato, Azuma, and Sakata; Design of Alloy Electrocatalysts for C02 Reduction III. The Selective and Reversible Reduction of C02 on Cu Alloy Electrodes; J. Electrochem. Soc., vol. 138, No. 11, Nov. 1991 © The Electrochemical Society, Inc., pp. 3382-3389.
Soichiro Yamamura, Hiroyuki Kojima, Jun Iyoda and Wasaburo Kawai; Photocatalytic Reduction of Carbon Dioxide with Metal-Loaded SiC Powders; J. Eleciroanal. Chem., 247 (1988) 333-337, Elsevier Sequoia S.A., Lausanne—Printed in the Netherlands.
R. Piercy, N. A. Hampson; The electrochemistry of indium, Journal of Applied Electrochemistry 5 (1975) 1-15, Printed in Great Britain, © 1975 Chapman and Hall Ltd.
C. K. Watanabe, K. Nobe; Electrochemical behaviour of indium in H2S04, Journal of Applied Electrochemistry 6 (1976) 159-162, Printed in Great Britain, © 1976 Chapman and Hall Ltd.
Yumi Akahori, Nahoko Iwanaga, Yumi Kato, Osamu Hamamoto, and Mikita Ishii; New Electrochemical Process for CO2 Reduction to from Formic Acid from Combustion Flue Gases; Electrochemistry; vol. 72, No. 4 (2004), pp. 266-270.
Hamamoto, Akahori, Goto, Kato, and Ishii; Modified Carbon Fiber Electrodes for Carbon Dioxide Reduction; Electrochemistry, vol. 72, No. 5 (2004), pp. 322-327.
S. Omanovicâ, M. Metikosï-Hukovic; Indium as a cathodic material: catalytic reduction of formaldehyde; Journal of Applied Electrochemistry 27 (1997) 35-41.
Hara, Kudo, and Sakata; Electrochemical reduction of carbon dioxide under high pressure on various electrodes in an aqueous electrolyte; Journal of Electroanalytical Chemistry 391 (1995) 141-147.
Hara et al., "Electrochemical Reduction of Carbon Dioxide Under High Pressure on Various Electrodes in an Aqueous Electrolyte", Journal of Electroanalytical Chemistry (no month, 1995), vol. 391, pp. 141-147.
Yamamoto et al., "Production of Syngas Plus Oxygen From CO2 in a Gas-Diffusion Electrode-Based Electrolytic Cell", Electrochimica Acta (no month, 2002), vol. 47, pp. 3327-3334.
Seshadri et al., "A New Homogeneous Electrocatalyst for the Reduction of Carbon Dioxide to Menthanol at Low Overpotential", Journal of Electroanalytical Chemistry, 372 pp. 145-150, Jul. 8, 1994, figure 1; p. 146-147.
Doherty, "Electrochemical Reduction of Butyraldehyde in the Presence of CO2", Electrochimica Acta 47(2002) 2963-2967.
Udupa et al., "The Electrolytic Reduction of Carbon Dioxide to Formic Acid", Electrochimica Acta (no month, 1971), vol. 16, pp. 1593-1598.
Jitaru, Maria, "Electrochemical Carbon Dioxide Reduction"—Fundamental and Applied Topics (Review), Journal of the University of Chemical Technology and Metallurgy (2007), vol. 42, No. 4, pp. 333-344.
Sloop et al., "The Role of Li-ion Battery Electrolyte Reactivity in Performance Decline and Self-Discharge", Journal of Power Sources (no month, 2003), vols. 119-121, pp. 330-337.
Shibata, Masami, et al., "Electrochemical Synthesis of Urea at Gas-Diffusion Electrodes", J. Electrochem. Soc., vol. 145, No. 2, Feb. 1998, pp. 595-600, The Electrochemical Society, Inc.
Shibata, Masami, et al., "Simultaneous Reduction of Carbon Dioxide and Nitrate Ions at Gas-Diffusion Electrodes with Various Metallophthalocyanine Catalysts", From a paper presented at the 4th International Conference on Electrocatalysis: From Theory to Industrial Applications', Sep. 22-25, 2002, Como, Italy, Electrochimica Acta 48 (2003) 3959-3958.
Harrison et al., "The Electrochemical Reduction of Organic Acids", Electroanalytical Chemistry and Interfacial Electrochemistry (no month, 1971), vol. 32, No. 1, pp. 125-135.
Chauhan et al., "Electro Reduction of Acetophenone in Pyridine on a D.M.E.", J Inst. Chemists (India) [Jul. 1983], vol. 55, No. 4, pp. 147-148.
Hori et al, chapter on "Electrochemical CO2 Reduction on Metal Electrodes," in the book Modern Aspects of Electrochemistry, vol. 42, pp. 106 and 107.
Jitaru, Lowy, Toma, Toma and Oniciu, "Electrochemical Reduction of Carbon Dioxide on Flat Metallic Cathodes," Journal of Applied Electrochemistry, 1997, vol. 27, p. 876.
Popic, Avramov, and Vukovic, "Reduction of Carbon Dioxide on Ruthenium Oxide and Modified Ruthenium Oxide Electrodes in 0.5M NaHCO3," Journal of Electroanalytical Chemistry, 1997, vol. 421, pp. 105-110.

(56) References Cited

OTHER PUBLICATIONS

Eggins and McNeill, "Voltammetry of Carbon Dioxide. I. A General Survey of Voltammetry at Different Electrode Materials in Different Solvents," Journal of Electroanalytical Chemistry, 1983, vol. 148, pp. 17-24.
Kostecki and Augustynski, "Electrochemical Reduction of CO2 at an Active Silver Electrode," Ber. Busenges. Phys. Chem., 1994, vol. 98, pp. 1510-1515.
Non-Final Office Action for U.S. Appl. No. 12/846,221, dated Nov. 21, 2012.
Non-Final Office Action for U.S. Appl. No. 12/846,011, dated Aug. 29, 2012.
Non-Final Office Action for U.S. Appl. No. 12/846,002, dated Sep. 11, 2012.
Non-Final Office Action for U.S. Appl. No. 12/845,995, dated Aug. 13, 2012.
Final Office Action for U.S. Appl. No. 12/845,995, dated Nov. 28, 2012.
Non-Final Office Action for U.S. Appl. No. 12/696,840, dated Jul. 9, 2012.
Non-Final Office Action for U.S. Appl. No. 13/472,039, dated Sep. 13, 2012.
DNV (Det Norske Veritas), Carbon Dioxide Utilization, Electrochemical Conversion of CO2—Opportunities and Challenges, Research and Innovation, Position Paper, Jul. 2011.
Matthew R. Hudson, Electrochemical Reduction of Carbon Dioxide, Department of Chemistry, State University of New York at Potsdam, Potsdam New York 13676, pp. 1-15, Dec. 9, 2005.
Colin Oloman and Hui Li, Electrochemical Processing of Carbon Dioxide, ChemSusChem 2008, 1, 385-391, (c) 2008 Wiley-VCH Verlag GmbH& Co. KGaA, Weinheim, www.chemsuschem.org.
Scibioh et al, "Electrochemical Reductin of Carbon Dioxide: A Status Report," Proc. Indian Natn Science Acad., 70, A, No. 3, May 2004, pp. 407-762.
Fukaya et al., "Electrochemical Reduction of Carbon Dioxide to Formate Catalyzed by Rh(bpy)3CI3", Kagaku Gijutsu Kenkyusho Hokoku (no month, 1986), vol. 81, No. 5, pp. 255-258. 1-page abstract only.
Li et al., "The Electro-Reduction of Carbon Dioxide in a Continuous Reactor", J. of Applied Electrochemistry (no month, 2005), vol. 35, pp. 955-965.
Kaneco et al., "Electrochemical Reduction of Carbon Dioxide to Ethylene with High Faradaic Efficiency at a Cu Electrode in CsOH/Methanol", Electrochimica Acta (no month, 1999), vol. 44, pp. 4701-4706.
Yuan et al., "Electrochemical Activation of Carbon Dioxide for Synthesis of Dimethyl Carbonate in an Ionic Liquid", Electrochimica Acta (no month, 2009), vol. 54, pp. 2912-2915.
U.S. Appl. No. 13/724,647, filed Dec. 21, 2012; Office Action mailed Oct. 17, 2013.
U.S. Appl. No. 13/787,481, filed Mar. 6, 2013; Office Action mailed Sep. 13, 2013.
U.S. Appl. No. 13/724,082, filed Dec. 21, 2012; Office Action mailed Aug. 12, 2013.
U.S. Appl. No. 13/724,522, filed Dec. 21, 2012; Office Action mailed Oct. 1, 2013.
U.S. Appl. No. 13/724,885, filed Dec. 21, 2012; Office Action mailed Aug. 21, 2013.
U.S. Appl. No. 13/724,231, filed Dec. 21, 2012; Office Action mailed Aug. 20, 2013.
Seshardi G., Lin C., Bocarsly A.B., A new homogeneous electrocatalyst for the reduction of carbon dioxide to methanol at low overpotential, Journal of Electroanalytical Chemistry, 1994, 372, pp. 145-150.
Seshadri et al., A New Homogeneous Electrocatalyst for the Reduction of Carbon Dioxide to Methanol at Low Overpotential, Journal of Electroanalytical Chemistry, 372 (1994), 145-50.
Green et al., Vapor-Liquid Equilibria of Formaldehyde-Methanol-Water, Industrial and Engineering Chemistry (Jan. 1955), vol. 47, No. 1, pp. 103-109.
Scibioh et al., Electrochemical Reduction of Carbon Dioxide: A Status Report, Proc Indian Natn Sci Acad (May 2004), vol. 70, A, No. 3, pp. 407-462.
Gennaro et al., Homogeneous Electron Transfer Catalysis of the Electrochemical Reduction of Carbon Dioxide. Do Aromatic Anion Radicals React in an Outer-Sphere Manner?, J. Am. Chem. Soc. (no month, 1996), vol. 118, pp. 7190-7196.
Perez et al., Activation of Carbon Dioxide by Bicyclic Amidines, J. Org. Chem. (no month, 2004), vol. 69, pp. 8005-8011.
Zaragoza Dorwald, Side Reactions in Organic Synthesis, 2005, Wiley-VCH Verlag GmbH & Co. KGaA, Weinheim, Preface. p. IX.
Liansheng et al, Journal of South Central University Technology, Electrode Selection of Electrolysis with Membrane for Sodium Tungstate Solution, 1999, 6(2), pp. 107-110.
Mahmood et al., Use of Gas-Diffusion Electrodes for High-Rate Electrochemical Reduction of Carbon Dioxide. II. Reduction at Metal Phthalocyanine-Impregnated Electrodes, J. of Appl. Electrochem. (no month, 1987), vol. 17, pp. 1223-1227.
Tanno et al., Electrolysis of Iodine Solution in a New Sodium Bicarbonate-Iodine Hybrid Cycle, International Journal of Hydrogen Energy (no month, 1984), vol. 9, No. 10, pp. 841-848.
Tinnemans et al., "Tetraaza-macrocyclic cobalt(II) and nickel(II) complexes as electron-transfer agents in the photo (electro)chemical and electrochemical reduction of carbon dioxide," Recl.Trav. Chim. Pays-Bas, Oct. 1984, 103: 288-295.
Bocarsly et al., "Photoelectrochemical conversion of carbon dioxide to methanol and higher alcohols, a chemical carbon sequestration strategy," Preprints of Symposia—American Chemical Society, Division of Fuel Chemistry, vol. 53, Issue: 1, pp. 240-241.

ELECTROCHEMICAL PRODUCTION OF BUTANOL FROM CARBON DIOXIDE AND WATER

CROSS-REFERENCE TO RELATED APPLICATIONS

The present application claims the benefit under 35 U.S.C. §119(e) of U.S. Patent Application Ser. No. 61/417,938, filed Nov. 30, 2010 and 61/418,034 filed Nov. 30, 2010.

The above-listed applications are hereby incorporated by reference in their entirety.

FIELD

The present disclosure generally relates to the field of electrochemical reactions, and more particularly to methods and/or systems for electrochemical production of butanol from carbon dioxide and water.

BACKGROUND

The combustion of fossil fuels in activities such as electricity generation, transportation, and manufacturing produces billions of tons of carbon dioxide annually. Research since the 1970s indicates increasing concentrations of carbon dioxide in the atmosphere may be responsible for altering the Earth's climate, changing the pH of the ocean and other potentially damaging effects. Countries around the world, including the United States, are seeking ways to mitigate emissions of carbon dioxide.

A mechanism for mitigating emissions is to convert carbon dioxide into economically valuable materials such as fuels and industrial chemicals. If the carbon dioxide is converted using energy from renewable sources, both mitigation of carbon dioxide emissions and conversion of renewable energy into a chemical form that can be stored for later use will be possible.

However, the field of electrochemical techniques in carbon dioxide reduction has many limitations, including the stability of systems used in the process, the efficiency of systems, the selectivity of the systems or processes for a desired chemical, the cost of materials used in systems/processes, the ability to control the processes effectively, and the rate at which carbon dioxide is converted. In particular, existing electrochemical and photochemical processes/systems have one or more of the following problems that prevent commercialization on a large scale. Several processes utilize metals, such as ruthenium or gold, that are rare and expensive. In other processes, organic solvents were used that made scaling the process difficult because of the costs and availability of the solvents, such as dimethyl sulfoxide, acetonitrile, and propylene carbonate. Copper, silver and gold have been found to reduce carbon dioxide to various products, however, the electrodes are quickly "poisoned" by undesirable reactions on the electrode and often cease to work in less than an hour. Similarly, gallium-based semiconductors reduce carbon dioxide, but rapidly dissolve in water. Many cathodes produce a mixture of organic products. For instance, copper produces a mixture of gases and liquids including carbon monoxide, methane, formic acid, ethylene, and ethanol. Such mixtures of products make extraction and purification of the products costly and can result in undesirable waste products that must be disposed. Much of the work done to date on carbon dioxide reduction is inefficient because of high electrical potentials utilized, low faradaic yields of desired products, and/or high pressure operation. The energy consumed for reducing carbon dioxide thus becomes prohibitive. Many conventional carbon dioxide reduction techniques have very low rates of reaction. For example, in order to provide economic feasibility, a commercial system currently may require densities in excess of 100 milliamperes per centimeter squared (mA/cm$^2$), while rates achieved in the laboratory are orders of magnitude less.

SUMMARY

A method for electrochemical reduction of carbon dioxide to produce butanol may include, but is not limited to, steps (A) to (D). Step (A) may introduce water to a first compartment of an electrochemical cell. The first compartment may include an anode. Step (B) may introduce carbon dioxide to a second compartment of the electrochemical cell. The second compartment may include a solution of an electrolyte, a catalyst, and a cathode. Step (C) may apply an electrical potential between the anode and the cathode in the electrochemical cell sufficient for the cathode to reduce the carbon dioxide to a product mixture. Step (D) may separate butanol from the product mixture.

Another method for electrochemical reduction of carbon dioxide to produce butanol may include, but is not limited to, steps (A) to (F). Step (A) may introduce water to a first compartment of a first electrochemical cell. The first compartment may include an anode. Step (B) may introduce carbon dioxide to a second compartment of the first electrochemical cell. The second compartment may include a solution of an electrolyte, a catalyst, and a cathode. Step (C) may apply an electrical potential between the anode and the cathode in the first electrochemical cell sufficient for the cathode to reduce the carbon dioxide to an intermediate product mixture. Step (D) may separate a two-carbon intermediate from the intermediate product mixture. Step (E) may introduce the two-carbon intermediate to a second electrochemical cell. The second electrochemical cell may include an anode in a first cell compartment and a cathode in a second cell compartment. The cathode may reduce the two-carbon intermediate to a product mixture. Step (F) may separate butanol from the product mixture.

A system for electrochemical reduction of carbon dioxide to produce butanol may include, but is not limited to, a first electrochemical cell including a first cell compartment, an anode positioned within the first cell compartment, a second cell compartment, a separator interposed between the first cell compartment and the second cell compartment, and a cathode and a catalyst positioned within the second cell compartment. The system may also include a carbon dioxide source, where the carbon dioxide source is coupled with the second cell compartment and is configured to supply carbon dioxide to the cathode for reduction of the carbon dioxide to an intermediate product mixture. The system may also include an extractor configured to separate a two-carbon intermediate from the product mixture. The system may further include a second electrochemical cell configured to receive the two-carbon intermediate. The second electrochemical cell may include a first cell compartment, an anode positioned within the first cell compartment, a second cell compartment, a separator interposed between the first cell compartment of the second electrochemical cell and the second cell compartment of the second electrochemical cell, and a cathode positioned within the second cell compartment of the second electrochemical cell. The cathode of the second electrochemical cell may be configured to reduce the two-carbon intermediate to butanol.

It is to be understood that both the foregoing general description and the following detailed description are exemplary and explanatory only and are not necessarily restrictive of the disclosure as claimed. The accompanying drawings, which are incorporated in and constitute a part of the specification, illustrate an embodiment of the disclosure and together with the general description, serve to explain the principles of the disclosure.

BRIEF DESCRIPTION OF THE DRAWINGS

The numerous advantages of the present disclosure may be better understood by those skilled in the art by reference to the accompanying figures in which.

DETAILED DESCRIPTION

Figure 1:
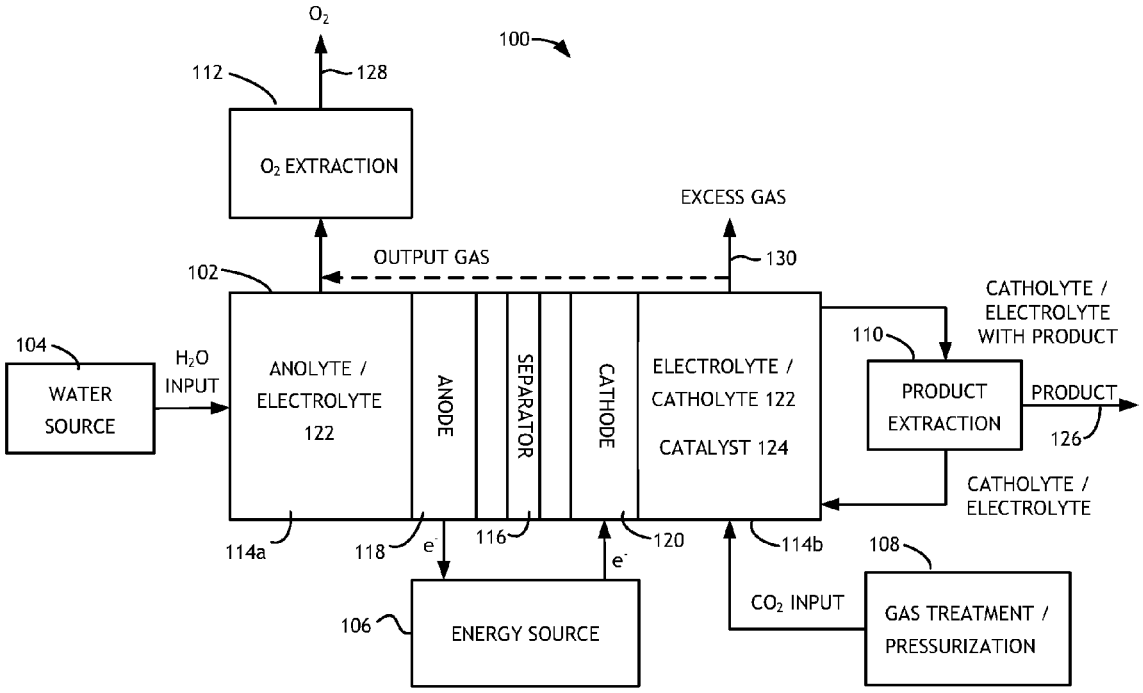
FIG. 1 is a block diagram of a system in accordance with an embodiment of the present disclosure.

Reference will now be made in detail to the presently preferred embodiments of the present disclosure, examples of which are illustrated in the accompanying drawings.

In accordance with some embodiments of the present disclosure, an electrochemical system is provided that generally allows carbon dioxide and water to be converted to butanol. In some embodiments, the production of butanol from carbon dioxide and water may occur in a one-stage or a two-stage process. In the one-stage process, butanol may be produced with low yields and low selectivity. In the two-stage process, butanol may be produced with improved reaction rates, yield, and selectivity as compared to the direct conversion of carbon dioxide and water to butanol in the one-stage process.

Butanol (which includes the isomer 2-butanol, also called sec-butanol, and the isomer 1-butanol, also called n-butanol) is an industrial chemical used around the world. Industrially, butanol is produced via gas phase chemistry, using oil and natural gas as feedstocks. 2-butanol may be produced via the acid-catalyzed hydration of 1-butene or 2-butene, where 1-butene and 2-butene may be obtained via catalytic cracking of petroleum. 1-butanol may be produced via the hydroformylation of propylene to butryaldehyde, where the butyraldehyde is subsequently hydrogenated to 1-butanol. Propylene itself may be derived from catalytic cracking of petroleum, whereas the carboxyl group introduced via hydroformylation may be from syngas derived from natural gas. In addition to using non-renewable oil and natural gas as feedstocks, the overall process of industrially synthesizing butanol using current techniques requires a large amount of energy, which generally comes from natural gas. The combustion of natural gas contributes to the concentration of carbon dioxide in the atmosphere and thus, global climate change.

Additional production techniques for butanol include production of butanol via biological pathways. However, such biological processes can be resource intensive due to the large amounts of land, fertilizer, and water necessary to grow the crops used to sustain fermentation processes.

In some embodiments of the present disclosure, the energy used by the system may be generated from an alternative energy source to avoid generation of additional carbon dioxide through combustion of fossil fuels. In general, the embodiments for the production of butanol from carbon dioxide and water do not require oil or natural gas as feedstocks. Some embodiments of the present invention thus relate to environmentally beneficial methods and systems for reducing carbon dioxide, a major greenhouse gas, in the atmosphere thereby leading to the mitigation of global warming. Moreover, certain processes herein are preferred over existing electrochemical processes due to being stable, efficient, having scalable reaction rates, occurring in water, and having selectivity of butanol.

For electrochemical reductions, the electrode may be a suitable conductive electrode, such as Al, Au, Ag, C, Cd, Co, Cr, Cu, Cu alloys (e.g., brass and bronze), Ga, Hg, In, Mo, Nb, Ni, Ni alloys, Ni—Fe alloys, Sn, Sn alloys, Ti, V, W, Zn, stainless steel (SS), austenitic steel, ferritic steel, duplex steel, martensitic steel, Nichrome, elgiloy (e.g., Co—Ni—Cr), degenerately doped n-Si, degenerately doped n-Si:As and degenerately doped n-Si:B. Other conductive electrodes may be implemented to meet the criteria of a particular application. For photoelectrochemical reductions, the electrode may be a p-type semiconductor, such as p-GaAs, p-GaP, p-InN, p-InP, p-CdTe, p-$GaInP_2$ and p-Si. Other semiconductor electrodes may be implemented to meet the criteria of a particular application.

Before any embodiments of the invention are explained in detail, it is to be understood that the embodiments may not be limited in application per the details of the structure or the function as set forth in the following descriptions or illustrated in the figures of the drawing. Different embodiments may be capable of being practiced or carried out in various ways. Also, it is to be understood that the phraseology and terminology used herein is for the purpose of description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage.

A use of electrochemical or photoelectrochemical reduction of carbon dioxide and water, tailored with certain electrocatalysts, may produce butanol in a yield of approximately less than 10% as a relative percentage of carbon-containing products, particularly when metallic cathode materials are employed. The reduction of the carbon dioxide may be suitably achieved efficiently in a divided electrochemical or photoelectrochemical cell in which (i) a compartment contains an anode suitable to oxidize or split the water, and (ii) another compartment contains a working cathode electrode and a catalyst. The compartments may be separated by a porous glass frit, microporous separator, ion exchange membrane, or other ion conducting bridge. Both compartments generally contain an aqueous solution of an electrolyte. Carbon dioxide gas may be continuously bubbled through the cathodic electrolyte solution to saturate the solution or the solution may be pre-saturated with carbon dioxide.

Advantageously, the carbon dioxide may be obtained from any source (e.g., an exhaust stream from fossil-fuel burning power or industrial plants, from geothermal or natural gas wells or the atmosphere itself). Most suitably, the carbon dioxide may be obtained from concentrated point sources of generation prior to being released into the atmosphere. For example, high concentration carbon dioxide sources may frequently accompany natural gas in amounts of 5% to 50%, exist in flue gases of fossil fuel (e.g., coal, natural gas, oil, etc.) burning power plants, and high purity carbon dioxide may be exhausted from cement factories, from fermenters used for industrial fermentation of ethanol, and from the manufacture of fertilizers and refined oil products. Certain geothermal steams may also contain significant amounts of carbon dioxide. The carbon dioxide emissions from varied industries, including geothermal wells, may be captured on-site. Separation of the carbon dioxide from such exhausts is known. Thus, the capture and use of existing atmospheric carbon dioxide in accordance with some embodiments of the present invention generally allow the carbon dioxide to be a renewable and unlimited source of carbon.

Referring to FIG. 1, a block diagram of a system 100 is shown in accordance with a specific embodiment of the present invention. System 100 may be utilized for the one-stage process for the production of butanol from carbon dioxide and water. The system (or apparatus) 100 generally comprises a cell (or container) 102, a liquid source 104, a power source 106, a gas source 108, a first extractor 110 and a second extractor 112. A product or product mixture may be presented from the first extractor 110. An output gas may be presented from the second extractor 112.

The cell 102 may be implemented as a divided cell. The divided cell may be a divided electrochemical cell and/or a divided photochemical cell. The cell 102 is generally operational to reduce carbon dioxide ($CO_2$) into butanol. The reduction generally takes place by bubbling carbon dioxide and an aqueous solution of an electrolyte in the cell 102. A cathode 120 in the cell 102 may reduce the carbon dioxide into a product mixture that may include one or more compounds. For instance, the product mixture may include at least one of butanol, formic acid, methanol, glycolic acid, glyoxal, acetic acid, ethanol, acetone, or isopropanol. In particular implementations, butanol may account for less than approximately 10% of the total yield of organic compounds in the product mixture.

The cell 102 generally comprises two or more compartments (or chambers) 114*a*-114*b*, a separator (or membrane) 116, an anode 118, and a cathode 120. The anode 118 may be disposed in a given compartment (e.g., 114*a*). The cathode 120 may be disposed in another compartment (e.g., 114*b*) on an opposite side of the separator 116 as the anode 118. An aqueous solution 122 may fill both compartments 114*a*-114*b*. The aqueous solution 122 may include water as a solvent and water soluble salts (e.g., potassium chloride (KCl)). A catalyst 124 may be added to the compartment 114*b* containing the cathode 120.

The liquid source 104 may implement a water source. The liquid source 104 may be operational to provide pure water to the cell 102.

The power source 106 may implement a variable voltage source. The power source 106 may be operational to generate an electrical potential between the anode 118 and the cathode 120. The electrical potential may be a DC voltage.

The gas source 108 may implement a carbon dioxide source. The source 108 is generally operational to provide carbon dioxide to the cell 102. In some embodiments, the carbon dioxide is bubbled directly into the compartment 114*b* containing the cathode 120.

The first extractor 110 may implement an organic product and/or inorganic product extractor. The extractor 110 is generally operational to extract (separate) one or products of the product mixture (e.g., butanol) from the electrolyte 122. The extracted products may be presented through a port 126 of the system 100 for subsequent storage and/or consumption by other devices and/or processes.

The second extractor 112 may implement an oxygen extractor. The second extractor 112 is generally operational to extract oxygen (e.g., $O_2$) byproducts created by the reduction of the carbon dioxide and/or the oxidation of water. The extracted oxygen may be presented through a port 128 of the system 100 for subsequent storage and/or consumption by other devices and/or processes. Chlorine and/or oxidatively evolved chemicals may also be byproducts in some configurations, such as in an embodiment of processes other than oxygen evolution occurring at the anode 118. Such processes may include chlorine evolution, oxidation of organics to other saleable products, waste water cleanup, and corrosion of a sacrificial anode. Any other excess gases (e.g., hydrogen) created by the reduction of the carbon dioxide and water may be vented from the cell 102 via a port 130.

In the reduction of carbon dioxide to butanol, water may be oxidized (or split) to protons and oxygen at the anode 118 while the carbon dioxide is reduced to the product mixture at the cathode 120. The electrolyte 122 in the cell 102 may use water as a solvent with any salts that are water soluble, including potassium chloride (KCl) and with a suitable catalyst 124, such as an imidazole catalyst, a pyridine catalyst, or a substituted variant of imidazole or pyridine. Cathode materials generally include any conductor. However, efficiency of the process may be selectively increased by employing a catalyst/cathode combination selective for reduction of carbon dioxide to butanol (and/or other compounds included in the product mixture). For catalytic reduction of carbon dioxide, the cathode materials may include Sn, Ag, Cu, steel (e.g., 316 stainless steel), and alloys of Cu and Ni. The materials may be in bulk form. Additionally and/or alternatively, the materials may be present as particles or nanoparticles loaded onto a substrate, such as graphite, carbon fiber, or other conductor.

An anode material sufficient to oxidize or split water may be used. The overall process may be generally driven by the power source 106. Combinations of cathodes 120, electrolytes 122, and catalysts 124 may be used to control the reaction products of the cell 102.

In one implementation of the one-stage process of producing butanol from carbon dioxide and water, a low yield, low selectivity for butanol may be obtained using an approximately 400 mM concentration of imidazole catalyst, KCl electrolyte, and a 316 stainless steel cathode. The process may proceed via the following reactions, with the heterocyclic catalyst facilitating the reaction similar to NADPH/$NADP^+$ in the Calvin Cycle:

| | | |
|---|---|---|
| Cathode: | $4CO_2 + 24H^+ + 24e^- \rightarrow C_4H_9OH + 7H_2O$ | ($E^0 = -0.41$ V vs. SCE at pH 6) |
| Anode: | $12H_2O \rightarrow 24H^+ + 24e^- + 6O_2$ | ($E^0 = 0.63$ V vs. SCE at pH 6) |
| Cell: | $4CO_2 + 5H_2O \rightarrow C_4H_9OH + 6O_2$ | ($E^0 = -1.04$ V at 25° C.) |

The one-stage process of producing butanol from carbon dioxide and water may yield additional organic products, including formic acid and acetic acid, which were observed by gas chromatography (GC) and nuclear magnetic resonance (NMR) with greater relative yields than butanol. Products other than butanol in the product mixture (e.g., formic acid, acetic acid, methanol, ethanol, acetone, and/or propanol) may be reaction intermediates. For instance, because the reaction to produce butanol requires a transfer of 24 electrons and protons, butanol production may be likely to be kinetically limited relative to reaction intermediates that require fewer electron and proton transfers. For greater selectivity, yield, and reaction rates, the two-stage process for producing butanol from carbon dioxide and water may be employed. The two-stage process includes two cells with the following reactions:

| | | |
|---|---|---|
| Cell 1: | $2CO_2 + H_2O \rightarrow OCHCHO + 1\frac{1}{2} O_2$ | ($E^0 = -1.44$ V at 25° C.) |
| Cell 2: | $2(OCHCHO) + 3H_2O \rightarrow C_4H_9OH + 3O_2$ | ($E^0 = -1.76$ V at 25° C.) |

The reaction in each of cell 1 and cell 2 requires six electrons per glyoxal molecule (OCHCHO). Although the total energy requirement for the two-stage process may be higher than the one-stage process for producing butanol from carbon dioxide and water, much higher selectivity and faradaic yield (current efficiency) may be provided via the two-stage process. For instance, experiments were conducted wherein a greater than 25% faradaic yield for glyoxal with greater than 90% selectivity were possible. Moreover, glyoxal was converted to 2-butanol in the second cell with greater than 99% selectivity.

Figure 2:
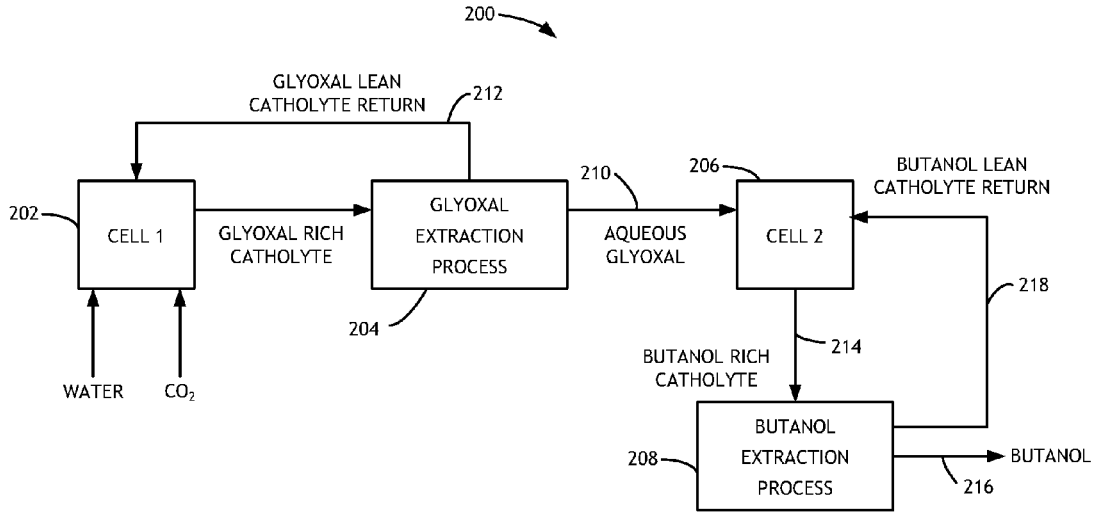
FIG. 2 is a block diagram of a system in accordance with another embodiment of the present disclosure.

Referring to FIG. 2, a block diagram of a system 200 is shown in accordance with a specific embodiment of the present invention. System 200 may be utilized for the two-stage process for the production of butanol from carbon dioxide and water. The system (or apparatus) 200 generally comprises a first cell 202, a first extractor 204, a second cell 206, and a second extractor 208. The first cell 202 and the second cell 206 may each utilize the divided cell structure as disclosed with reference to cell 102 of FIG. 1.

The first cell 202 is generally operational to reduce carbon dioxide into a glyoxal rich mixture. In a particular implementation, the first cell 202 incorporates in the cathode compartment a type 430 stainless steel cathode, a 60 mM concentration of imidazole catalyst, and a 0.5M KCl electrolyte. The cathode compartment may be pH adjusted to between approximately 5 and approximately 8 by using, for example, sodium hydroxide (NaOH) or potassium hydroxide (KOH). Carbon dioxide may be bubbled through the cathode compartment, where the cathode potential may be approximately −1V vs. SCE (saturated calomel electrode). Pyrrole and other chemicals that react to convert aldehydes to imines or acetals may be added to the catholyte of the first cell 202 to drive the kinetics of the reaction in the cell toward greater glyoxal production. A solid sorbent may serve the same role and also simultaneously extract glyoxal for use in the second cell 206. The anolyte in the first cell 202 may consist of water with an electrolyte to permit water oxidation at the anode. Water may be added to the anode compartment as it is consumed for the process. Glyoxal may be extracted from the product mixture of the first cell 202 with the first extractor 204 which may incorporate any combination of derivitization, liquid-liquid extraction, and/or solid sorbents. While FIG. 2 depicts the first extractor 204 separated from the first cell 202, it may be appreciated that various extraction processes and instrumentation may be part of, implemented with, and/or coupled to the first cell 202 in order to extract a particular product (e.g., glyoxal) of the product mixture.

Glyoxal formation in the cathode compartment of the first cell 202 may be aided through various combinations of cathode materials, catalysts, and cell conditions. For instance, the cathode material may include indium, tin, molybdenum, 316 stainless steel, nickel 625, nickel 600, nickel-chromium, elgiloy (cobalt-nickel-chromium), and copper-nickel. Iron, steel, cobalt, chromium, and alloys thereof may also be utilized as cathode material in the cathode compartment of the first cell 202. Catalysts in the first cell 202 may be include pyridine, quinoline, 1-methyl imidazole, 4,4' bipyridine, and other heterocycles to convert carbon dioxide to glyoxal under the appropriate conditions. Such conditions may include lower pHs and differing electrolytes. The combination of cathode, catalyst, and cell conditions sufficient for the reaction in the cathode compartment of the first cell 202 may be disclosed in U.S. patent application Ser. No. 12/846,221, entitled "Reducing Carbon Dioxide to Products," which is hereby incorporated by reference.

The product mixture of the first cell 202 may include one or more two-carbon intermediates including glyoxal, oxalic acid, glyoxylic acid, glycolic acid, acetic acid, and acetaldehyde. One or more of the components of the product mixture may be utilized as an intermediate in the two-stage process (i.e., may be used as an input to the second cell 206). Glyoxal may include beneficial characteristics for use as the intermediate, including, but not limited to, being non-corrosive, being stable in water, and requiring six electrons for its formation from carbon dioxide and water. Generally, the first extractor 204 is sufficient to provide a component-rich portion 210 as an input to the second cell 206, and a component-lean portion 212 (e.g., catholyte rich portion) that may be utilized for additional reactions in the first cell 202.

In the second cell 206, a two-carbon intermediate, such as glyoxal, may be converted to 2-butanol via electrohydrodimerization, as disclosed in U.S. patent application Ser. No. 12/846,011, "Heterocycle Catalyzed Electrochemical Process," which is hereby incorporated by reference. In a particular implementation, aqueous glyoxal is introduced as a reactant to the second cell 206 with concentrations of up to approximately 40%. The catholyte in the second cell 206 may include water and KCl, or other suitable electrolyte. The cathode compartment in the second cell 206 may include a catalyst, including a heterocyclic catalyst, such as 4,4' bipridine. However, in some instances, no catalyst or no heterocyclic catalyst is provided in the cathode compartment in the second cell 206, whereby the cathode itself facilitates the two-carbon intermediate to butanol reaction. The anolyte in the anode compartment of the second cell 206 may include water with an electrolyte sufficient for water oxidation at the anode.

The second cell 206 may include a butanol rich output 214 as a product of the second cell reactions. The output 214 may also include a portion of catholyte. Generally, the second extractor 208 is sufficient to provide a butanol product 216, i.e., the product of the two-stage process of system 200, and a butanol-lean portion 218 (i.e., a butanol lean/catholyte rich portion) from the second extractor 208 which may be utilized for additional reactions in the second cell 204.

As described herein, the present disclosure may be implemented via a one-stage or a two-stage process. The one-stage process may result in a product stream including butanol with relatively larger amounts of one-, two-, and three-carbon products. The one-stage process may be an electrochemical process (e.g., driven by any electric power source) or a photochemical process, which may occur on a photovoltaic solar panel. The two-stage process generally produces butanol with high efficiency.

Figure 3:
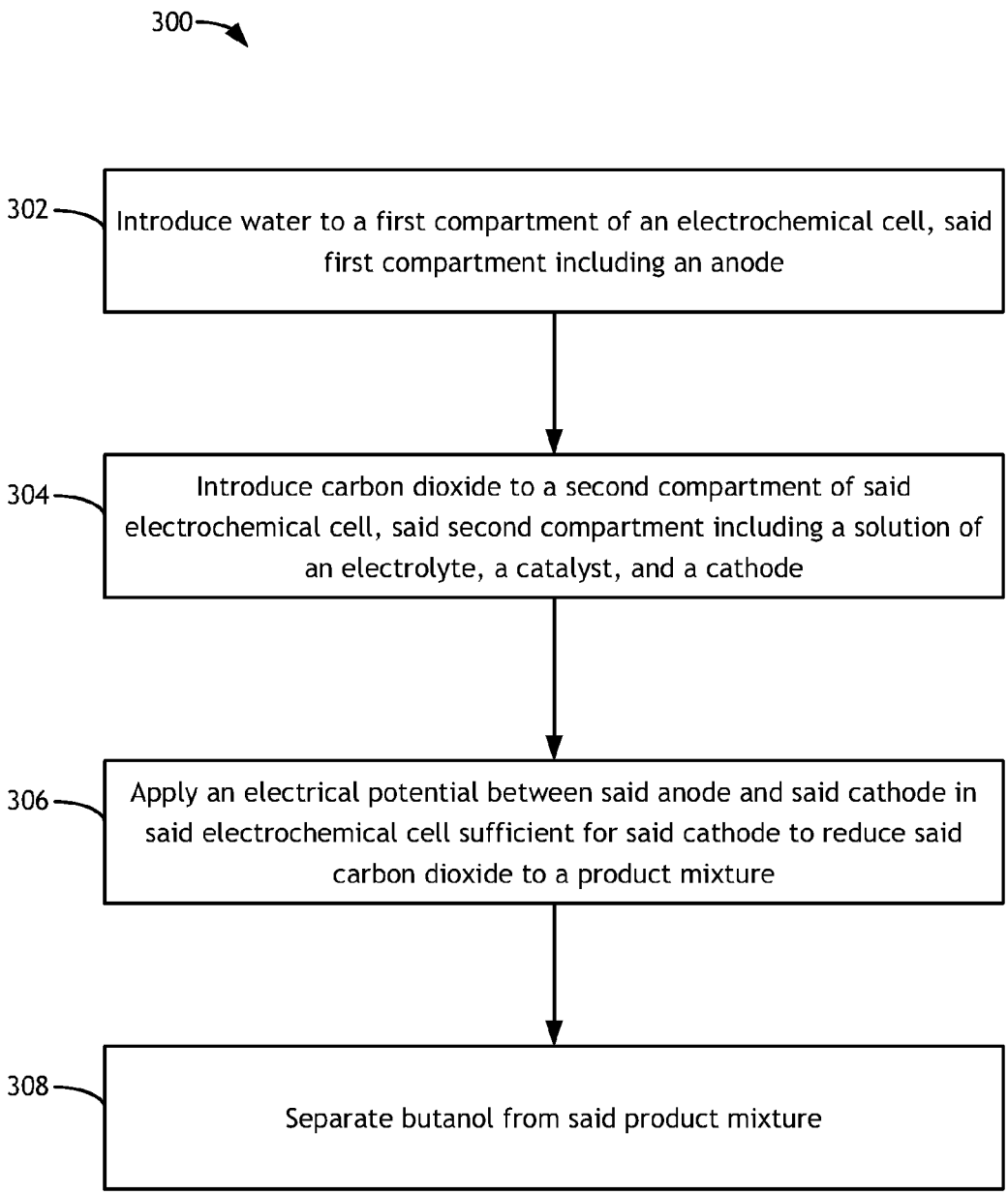
FIG. 3 is a flow diagram of an example method of electrochemical production of butanol.

Referring to FIG. 3, a flow diagram of an example method 300 for producing butanol from carbon dioxide and water in a one-stage process is shown. The method (or process) 300 generally comprises a step (or block) 302, a step (or block) 304, a step (or block) 306, and a step (or block) 308. The method 300 may be implemented using the system 100.

In the step 302, water may be introduced to a first compartment of an electrochemical cell. The first compartment may include an anode. Introducing carbon dioxide to a second compartment of the electrochemical cell may be performed in the step 304. The second compartment may include a solution of an electrolyte, a catalyst, and a cathode. In the step 306, an electric potential may be applied between the anode and the cathode in the electrochemical cell sufficient for the cathode to reduce the carbon dioxide to a product mixture. Separating butanol from the product mixture may be performed in the step 308.

Figure 4:
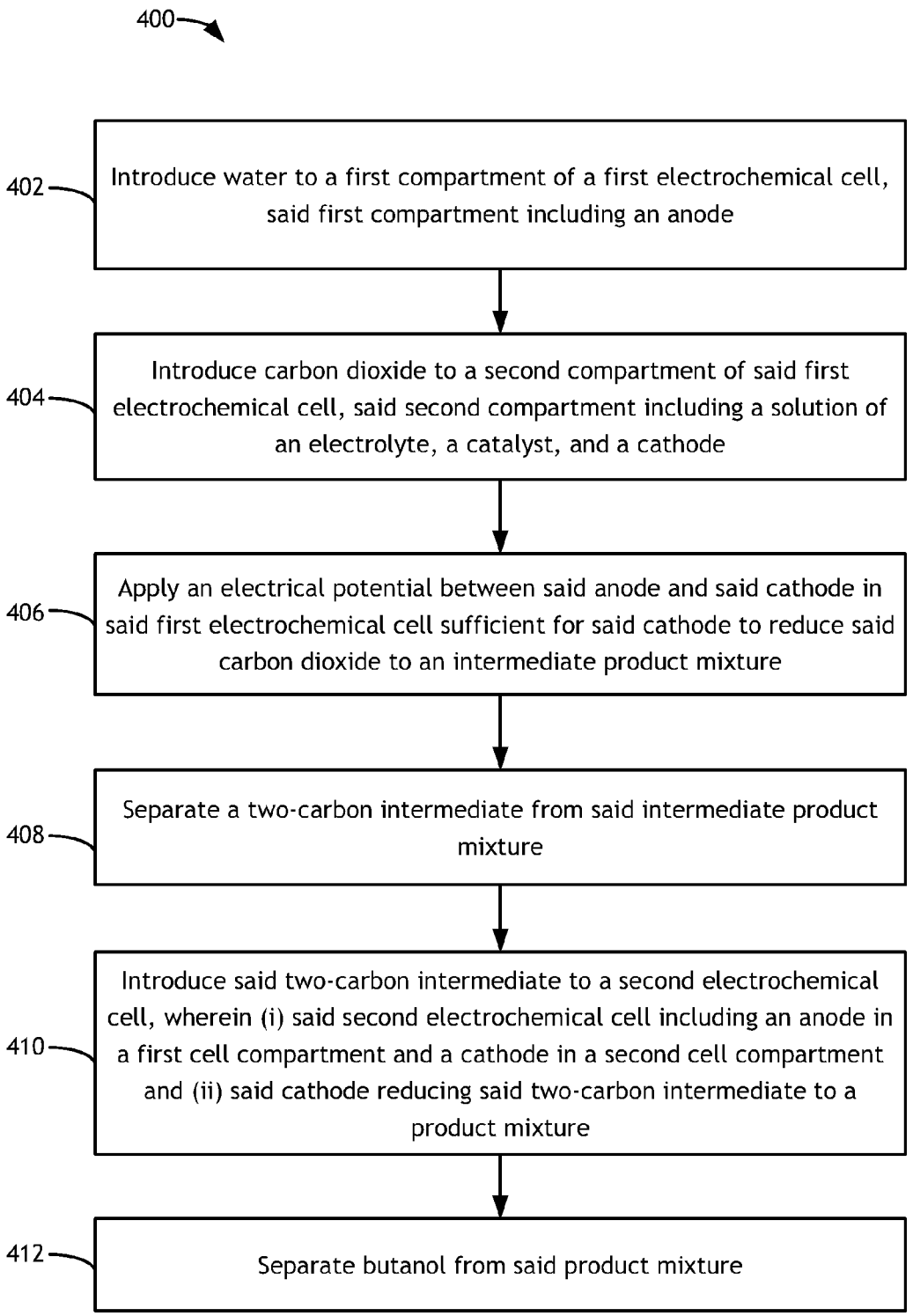
FIG. 4 is a flow diagram of another example method of electrochemical production of butanol.

Referring to FIG. 4, a flow diagram of an example method 400 for producing butanol from carbon dioxide and water in a two-stage process is shown. The method (or process) 400 generally comprises a step (or block) 402, a step (or block) 404, a step (or block) 406, a step (or block) 408, a step (or block) 410, and a step (or block) 412. The method 400 may be implemented using the system 200.

In the step 402, water may be introduced to a first compartment of a first electrochemical cell. The first compartment may include an anode. Introducing carbon dioxide to a second compartment of the first electrochemical cell may be performed in the step 404. The second compartment may include a solution of an electrolyte, a catalyst, and a cathode. In the step 406, an electric potential may be applied between the anode and the cathode in the first electrochemical cell sufficient for the cathode to reduce the carbon dioxide to an intermediate product mixture. Separating a two-carbon intermediate from the intermediate product mixture may be performed in the step 408. In the step 410, the two-carbon intermediate may be introduced to a second electrochemical cell. The second electrochemical cell may include an anode in a first cell compartment and a cathode in a second cell compartment. The cathode may reduce the two-carbon intermediate to a product mixture. In the step 412, butanol may be separated from the product mixture.

It is believed that the present disclosure and many of its attendant advantages will be understood by the foregoing description, and it will be apparent that various changes may be made in the form, construction and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. A method for electrochemical production of butanol, comprising:

(A) introducing water to a first compartment of a first electrochemical cell, said first compartment including an anode;

(B) introducing carbon dioxide to a second compartment of said first electrochemical cell, said second compartment including a solution of an electrolyte, a catalyst, and a cathode;

(C) applying an electrical potential between said anode and said cathode in said first electrochemical cell sufficient for said cathode to reduce said carbon dioxide to an intermediate product mixture;

(D) separating a two-carbon intermediate from said intermediate product mixture;

(E) introducing said two-carbon intermediate to a second electrochemical cell, wherein (i) said second electrochemical cell including an anode in a first cell compartment and a cathode in a second cell compartment and (ii) said cathode reducing said two-carbon intermediate to a product mixture; and (F) separating butanol from said product mixture.

2. The method of claim 1, wherein said two-carbon intermediate includes at least one of glyoxal, oxalic acid, glyoxylic acid, glycolic acid, acetic acid, or acetaldehyde.

3. The method of claim 2, wherein said two-carbon intermediate includes glyoxal.

4. The method of claim 1, wherein said solution of electrolyte includes potassium chloride.

5. The method of claim 1, wherein said cathode of said first electrochemical cell includes a cathode material for reducing said carbon dioxide to said intermediate product mixture, said cathode material including at least one of indium, tin, molybdenum, 316 stainless steel, nickel 625, nickel 600, nickel-chromium, elgiloy, copper-nickel, iron, iron alloy, steel, steel alloy, cobalt, cobalt alloy, chromium, or chromium alloy.

6. The method of claim 1, said catalyst of said first electrochemical cell includes a heterocycle catalyst.

7. The method of claim 6, wherein said heterocycle catalyst includes at least one of pyridine, quinoline, 1-methyl imidazole, or 4,4' bipyridine.

8. The method of claim 1, further comprising:

adjusting a pH of the second compartment of the first cell between approximately 5 and approximately 8.

9. The method of claim 1, wherein said butanol includes 2-butanol.

* * * * *